US007524227B2

(12) United States Patent
Nishimura

(10) Patent No.: US 7,524,227 B2
(45) Date of Patent: Apr. 28, 2009

(54) METHOD OF PRODUCING AN ELECTRON EMISSION DEVICE, METHOD OF PRODUCING AN ELECTRON SOURCE, METHOD OF PRODUCING AN IMAGE DISPLAY DEVICE, AND METHOD OF DRIVING AN ELECTRON EMISSION DEVICE

(75) Inventor: Michiyo Nishimura, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 734 days.

(21) Appl. No.: 11/075,855

(22) Filed: Mar. 10, 2005

(65) Prior Publication Data

US 2005/0202745 A1 Sep. 15, 2005

(30) Foreign Application Priority Data

Mar. 12, 2004 (JP) ..... 2004-070827

(51) Int. Cl.
*H01J 9/44* (2006.01)

(52) U.S. Cl. ..... 445/6; 445/3; 313/495

(58) Field of Classification Search ..... 313/495–497; 445/3, 6

See application file for complete search history.

(56) References Cited

U.S. PATENT DOCUMENTS

| | | | | |
|---|---|---|---|---|
| 5,209,687 | A | 5/1993 | Konishi | 445/6 |
| 5,210,462 | A | 5/1993 | Konishi | 313/495 |
| 6,267,636 | B1 | 7/2001 | Onishi et al. | 445/6 |
| 6,379,211 | B2 | 4/2002 | Onishi et al. | 445/73 |
| 6,490,433 | B1 | 12/2002 | Kawade | 445/6 |
| 6,582,268 | B1 | 6/2003 | Jindai et al. | 445/6 |
| 6,717,340 | B2 | 4/2004 | Nishimura | 313/310 |
| 6,824,437 | B2 | 11/2004 | Jindai et al. | 445/6 |
| 6,848,962 | B2 | 2/2005 | Kitamura et al. | |
| 2002/0031972 | A1 | 3/2002 | Kitamura et al. | |
| 2002/0036599 | A1 | 3/2002 | Nishimura et al. | 345/11 |
| 2002/0068496 | A1 | 6/2002 | Onishi et al. | 445/6 |
| 2002/0074947 | A1 * | 6/2002 | Tsukamoto | 315/169.3 |
| 2002/0090877 | A1 * | 7/2002 | Minami et al. | 445/6 |
| 2003/0104751 | A1 * | 6/2003 | Jindai et al. | 445/6 |
| 2005/0017651 | A1 | 1/2005 | Nishimura | 315/169.3 |
| 2005/0032255 | A1 | 2/2005 | Kitamura et al. | |

FOREIGN PATENT DOCUMENTS

| | | |
|---|---|---|
| JP | 8-162015 | 6/1996 |
| JP | 3062987 | 5/2000 |
| JP | 3094459 | 8/2000 |
| JP | 2000-311596 | 11/2000 |
| JP | 2002-150929 A | 5/2002 |
| JP | 2002-367508 | 12/2002 |

* cited by examiner

*Primary Examiner*—Nimeshkumar D. Patel
*Assistant Examiner*—Christopher M Raabe
(74) *Attorney, Agent, or Firm*—Fitzpatrick, Cella, Harper & Scinto

(57) ABSTRACT

A method of producing an electron emission device having a low threshold electric field needed to emit electrons without unintentional electron emission includes a first step of preparing a first conductive film, second conductive film, and a material which constitutes an electron emission part connected to the first conductive film, and a second step of setting a threshold electric field strength, which is needed to start electron emission in a situation where a higher electric potential is applied to the first conductive film than that applied to the second conductive film, to a value greater than a threshold electric field strength, which is needed to start electron emission in a situation where a higher electric potential is applied to the second conductive film than that applied to the first conductive film.

7 Claims, 17 Drawing Sheets

METHOD OF PRODUCING AN ELECTRON EMISSION DEVICE, METHOD OF PRODUCING AN ELECTRON SOURCE, METHOD OF PRODUCING AN IMAGE DISPLAY DEVICE, AND METHOD OF DRIVING AN ELECTRON EMISSION DEVICE

BACKGROUND OF THE INVENTION

1. Field of the Invention

The present invention relates to a method of producing an electron emission device using an electron emission film, and a method of producing an image display device having a plurality of electron emission devices.

2. Description of the Related Art

Electron emission devices can be classified into three types: a field emission (FE) type, an MIM type, and a surface conduction type. Basically, in any type, the electron emission device includes a cathode electrode including an electron emission part and a control electrode for controlling emission of electrons from the electron emission part or controlling electrons emitted from the electron emission part.

Electron emission devices of the FE type can be further classified into two types: a type (Spindt type) in which an opening is formed in a control electrode and a cathode electrode made of metal and having a sharp tip (formed in a cone shape) is disposed in the opening, and a type in which a cathode electrode having a diamond thin film (electron emission film) having a rather flat shape is disposed in an opening of a control electrode. An example of a Spindt-type electron emission device is disclosed in Japanese Patent Publication No. 3094459. In recent years, an FE-type electron emission device has been proposed which uses a carbon fiber such as a carbon nanotube instead of a cone-shaped cathode electrode of a Spindt-type electron emission device. Examples of electron emission devices of the surface conduction type may be found in Japanese Patent Publication No. 3062987, Japanese Patent Laid-Open No. 2002-367508, Japanese Patent Laid-Open No. 8-162015, and Japanese Patent Laid-Open No. 2000-311596.

An example of an application of the electron emission device is a flat panel display composed of a large number of electron emission devices arranged on a single substrate. The flat panel display using electron emission devices is of emissive type (light emissive type), and thus it can display a high-quality image with a high brightness and high contrast even in a well-lit environment.

In recent years, there has arisen a need for flat panel displays capable of displaying an image with higher resolution. To this end, there is a need for an electron emission device capable of emitting electrons in the form of a small beam. In general, to reduce the beam diameter, it is effective to reduce the strength of the electric field which is formed when the electron emission device is driven (when electrons are emitted during its operation). Thus, there is a need for an electron emission device having an electron emission part capable of emitting electrons using low strength electric fields.

In flat panel displays, not only high brightness but also high-quality halftone (gray-scale image) representation is required. To achieve high-quality halftone representation, a large electron emission current and control of electron emission are required. To this end, it is desirable that the electron emission device has a clear threshold for electron emission. That is, it is desirable that the electron emission device does not emit any electron in electric fields lower than a threshold electric field $E_{th}$ (or a threshold voltage $V_{th}$) and electron emission starts at the threshold electric field $E_{th}$. When such electron emission devices are used in a display, an off-state (a dark state) is obtained when the electric field is lower than $E_{th}$ ($V_{th}$) and an on-state (bright state) is obtained when the electric field is higher than $E_{th}$ ($V_{th}$). The contrast of the display is determined by the difference between the off-state (dark state) and the on-state (bright state). The higher the contrast, the better the halftone representation and the better the image quality.

It is also desirable that in the range of the electric field below $E_{th}$, no electrons be emitted and the current that has no contribution to the emission current (called a useless current or an ineffective current) should be as small as possible. That is, it is desirable that the electron emission device have as high an electron emission efficiency (=emission current/(emission current+useless current)) as possible. A high electron emission efficiency allows a reduction in power consumption and also a reduction in load imposed on a driver of the electron emission device.

It is also important that the electron emission device satisfying the above-described requirements can be produced with high repeatability and a high production yield.

SUMMARY OF THE INVENTION

Electron emission materials (or electron emission films) capable of emitting electrons in low strength electric fields have a tendency to be influenced by the production environment during a production process. Any change in the characteristics of the electron emission film during the production process makes it difficult to achieve the expected electron emission performance. In particular, the surface of the electron emission film has a large influence on the electron emission characteristic, and thus it is important to produce electron emission devices without contaminating the surface thereof.

Since electron emission characteristics of electron emission devices having a contaminated surface are unstable, a significant variation in electron emission characteristics among electron emission devices often occurs when many electron emission devices are arranged on a substrate. Thus, it is necessary to adjust the electron emission characteristics of the electron emission devices such that all electron emission devices have similar characteristics.

It is also important to produce electron emission devices at a low cost. To this end, it is desirable that the structure of the electron emission device be as simple as possible, and that the electron emission device can be produced via a simple process including small number of steps. In particular, to achieve a simple structure of an electron emission device, it is effective to form a control electrode and a cathode electrode having the same structure as that of the control electrode on a single substrate. In a case in which the cathode electrode is composed of a plurality of elements, as with a cathode electrode composed of a conductive film and an electron emission film formed on a surface of the conductive film, forming the cathode electrode and the control electrode into a symmetric structure allows simplification of a patterning process, and a simple structure is achieved. In this symmetric structure, both the control electrode and the cathode electrode have an area (electron emission part) capable of emitting electrons.

To achieve an electron emission device having an electron emission part capable of emitting electrons in low strength electric fields, it is necessary to solve the following problems.

1) Emission of Electrons from Control Electrode

As mentioned above, if a control electrode and a cathode electrode are symmetrical with respect to each other, electron emission from the control electrode can occur. For example, in a structure in which a plurality of electron emission devices are connected to each other via wirings, when a particular one of these electron emission devices is driven with the intention of emitting electrons from only that electron emission device, a voltage opposite to the driving voltage can be applied to some electron emission device (such that the potential of the cathode electrode becomes higher than the potential of the control electrode). Depending on the voltage between the control electrode and the cathode electrode, an electron can be emitted from a particular portion of the control electrode.

Electrons emitted from the control electrode result in a useless current (inefficient current). Such a useless current causes a problem, in particular, in an electron source having a large number of electron emission devices. The electron emission from the control electrode can be avoided if the electron emission part is formed only on the cathode electrode and the control electrode has no electron emission part. However, this results in an increase in complexity of the production process including the patterning process. Even when the production process is intended to form the electron emission part only on the cathode electrode, an electron emission material can unintentionally remain or deposit on the control electrode, and thus it is difficult to completely prevent electrons from being emitted from the control electrode.

In some cases, to minimize the change in characteristics of the electron emission device during the production process, the deposition of the emission material is performed at the last stage of the production process. Also in this case, there is a possibility that the electron emission material deposits on the control electrode (typically, gate electrode) and an undesirable electron emission part is formed on the control electrode.

2) Contribution of Anode Electrode to Electron Emission

When an electron emission device using an electron emission part capable of emitting electrons in low strength electric fields is used in a flat panel display or the like, another electrode (anode electrode) for irradiating a light-emitting member (such as a phosphor member) with electrons is necessary. The anode electrode attracts electrons emitted from the electron emission device such that electrons strike a light-emitting member (luminescent member) such as a phosphor disposed close to the anode electrode. In display devices, it is important to accelerate electrons to a sufficiently high energy such that high-brightness luminescence is obtained when electrons strike the light-emitting member. To this end, it is desirable to apply a large electric potential to the anode electrode. It is further desirable that the electric potential is constantly applied to the anode electrode. In this case, the control or modulation of the amount of electron emission is performed by a control electrode. In the electron emission device capable of emitting electrons in low strength electric fields, if the electric potential (electric field) applied to the anode electrode with respect to the potential of the cathode electrode or the control electrode is too high, the threshold electric field $E_{th}$ (or the threshold voltage $V_{th}$) of the electron emission device becomes vague or the threshold electric field $E_{th}$ (or the threshold voltage $V_{th}$) needed to emit electrons becomes too low. This causes electrons to be emitted from non-selected electron emission devices (in off-state) or causes an unintended amount of electrons to be continuously emitted from selected electron emission devices (in the on-state).

Thus, when electron emission devices are capable of emitting electrons in low strength electric fields, it is necessary to control unintentional electron emission described above at points 1) and 2).

In view of the above, the present invention provides a method of producing, using a simple production process, a high-efficiency electron emission device having a simple structure, capable of being driven by a low driving voltage, capable of well controlling the electron beam diameter, and emitting substantially no electrons in an off-state, thereby allowing good halftone representation (gray-scale image). The present invention also provides a method of producing an electron source having a high on/off ratio. Furthermore, the present invention provides a method of producing an image display device capable of displaying a high-resolution image with high contrast.

In a first aspect, the present invention provides a method of producing an electron emission device including a first conductive film having an electron emission part and a second conductive film spaced apart from the first conductive film, the electron emission device capable of being driven by applying a higher electric potential to the second conductive film than an electric potential of the first conductive film, the method including a first step of preparing a first conductive film, second conductive film, and a material which constitutes an electron emission part connected to the first conductive film, and a second step of setting a threshold electric field strength, which is needed to start electron emission in a situation where a higher electric potential is applied to the first conductive film than that applied to the second conductive film, to a value greater than a threshold electric field strength, which is needed to start electron emission in a situation where a higher electric potential is applied to the second conductive film than that applied to the first conductive film.

In a second aspect, the present invention provides a method of producing an electron emission device including a first conductive film having an electron emission part and a second conductive film spaced apart from the first conductive film, the electron emission device capable of being driven by applying a higher electric potential to the second conductive film than an electric potential of the first conductive film, the method including a first step of preparing a first conductive film, second conductive film, and a material which constitutes an electron emission part connected to the first conductive film, and a second step of applying a voltage between the first conductive film and the second conductive film so that a threshold electric field strength, which is needed to start electron emission in a situation where a higher electric potential is applied to the first conductive film than that applied to the second conductive film, becomes greater than a threshold electric field strength, which is needed to start electron emission in a situation where a higher electric potential is applied to the second conductive film than that applied to the first conductive film.

In these methods of producing an electron emission device, the second step may include the step of emitting electrons by applying a higher potential to the first conductive film than a potential applied to the second conductive film.

The second step may include the step of applying a first voltage between the first conductive film and the second conductive film and the step of applying a second voltage between the first conductive film and the second conductive film, the first voltage being applied such that the electric potential of the first conductive film becomes higher than the electric potential of the second conductive film, the second voltage being applied such that the electric potential of the second conductive film becomes higher than the electric potential of the first conductive film, the absolute value of the first voltage being greater than the absolute value of the second voltage.

The present invention also provides a method of producing an electron source including a plurality of electron emission devices, wherein the method includes the step of producing the plurality of electron emission devices using the method of producing the electron emission devices in the first aspect. The present invention also provides a method of producing an image display device including an electron source and a light-emitting member (such as a phosphor), wherein the method includes the step of producing the electron devices using the method of the producing the electron devices in the first aspect.

In a third aspect, the present invention provides a method of producing an electron source comprising a plurality of wirings extending in a row direction, a plurality of wirings extending in a column direction, and a plurality of electron emission devices each including a first conductive film having an electron emission part and a second conductive film spaced apart from the first conductive film, the method including a first step of arranging a plurality of units including a pair of first and second conductive film respectively, a plurality of wirings extending in the row direction and connecting a plurality of the first conductive film respectively, a plurality of wirings extending in the column direction and connecting a plurality of the second conductive film respectively, and a material constituting each electron emission part which is connected to the first conductive film constituting each of the units, and, a second step of applying a higher electric potential than a potential of the first conductive film to each of the second conductive films such that a threshold electric field strength of each unit, which is needed to start electron emission in a situation where a higher electric potential is applied to the first conductive film than that applied to the second conductive film, becomes greater than a threshold electric field strength of each unit, which is needed to start electron emission in a situation where a higher electric potential is applied to the second conductive film than that applied to the first conductive film, wherein in the second step, the electric potential applied to the second conductive film is higher than an electric potential that is applied to the second conductive film of non-selected electron emission device in a situation where the electron source is in actual operation.

In the aspects of the present invention, electrons may be emitted by applying an electric field lower than $1\times10^6$ V/cm to the electron emission part.

In the aspects of the present invention, the first conductive film and the second conductive film is spaced apart by 0.1 μm or greater.

In the aspects of the present invention, the electron emission part may be formed of a material selected from the group consisting of a carbon fiber, an insulating film having a dipole layer disposed on the surface thereof, a film formed mainly of carbon and including metal particles, and an amorphous carbon film.

The present invention also provides a method of producing an image display device including an electron source and a luminescent material, wherein the method includes the step of producing the electron devices using the method of the producing the electron devices in the second aspect.

The present invention also provides a method of driving the electron emission device, the electron source, or the image display device, produced using the method in the first and second aspects, wherein a driving voltage applied to the electron emission device is lower than the second voltage.

The production method according to the present invention in the first or the second aspect makes it possible to produce a high-efficiency electron emission device having a simple structure, capable of being driven by a low driving voltage, capable of well controlling the electron beam diameter, and capable of stably emitting electrons in low strength electric fields. The electron emission device has a simple structure and can be produced using a simple production process. The resultant electron emission device has a high on/off ratio and a good halftone representation can be achieved. Using the method of producing electron emission devices, an electron source and an image display device having a good driving characteristic can be produced.

Further features and advantages of the present invention will become apparent from the following description of exemplary embodiments (with reference to the attached drawings).

DESCRIPTION OF THE EMBODIMENTS

Embodiments of the present invention are described below with reference to the accompanying drawings. Note that specific sizes, materials and relative positions of respective parts, specific driving method, and the specific driving voltages described below are not intended to limit the scope of the present invention.

Figure 1A:
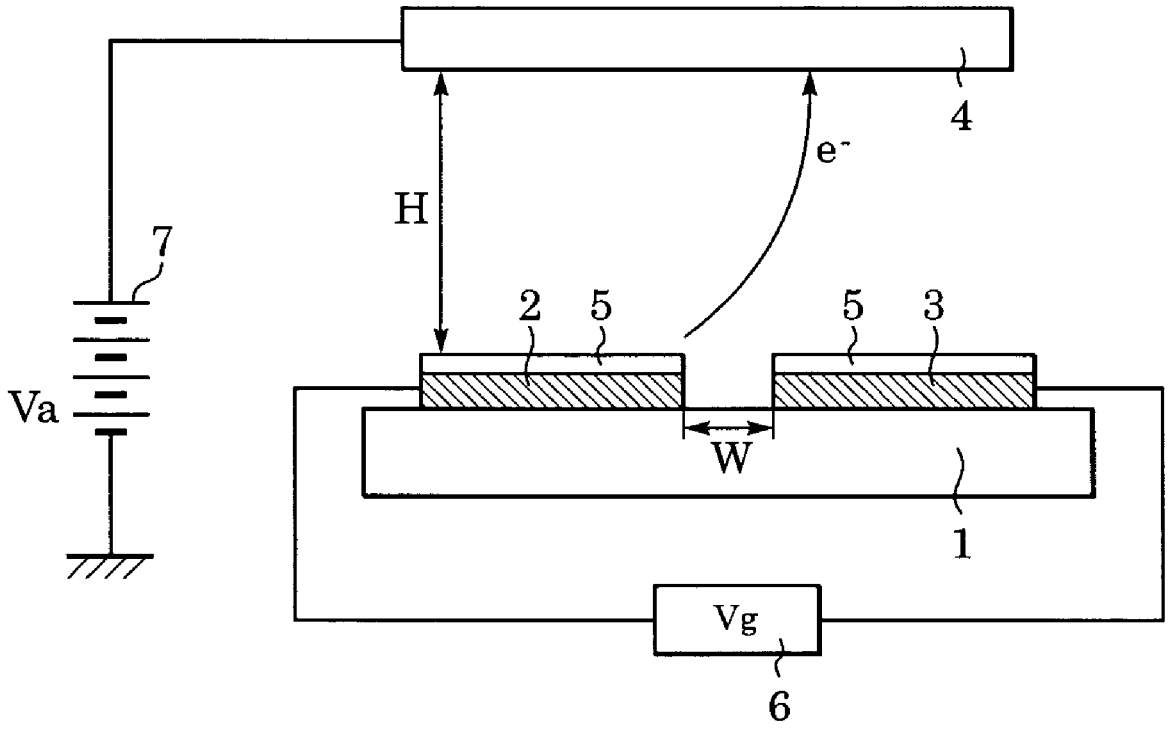
FIGS. 1A and 1B are a schematic diagrams showing an electron emission device according to an embodiment of the present invention, with FIG. 1A being a cross-section view and FIG. 1B being a plan view.
Figure 1B:
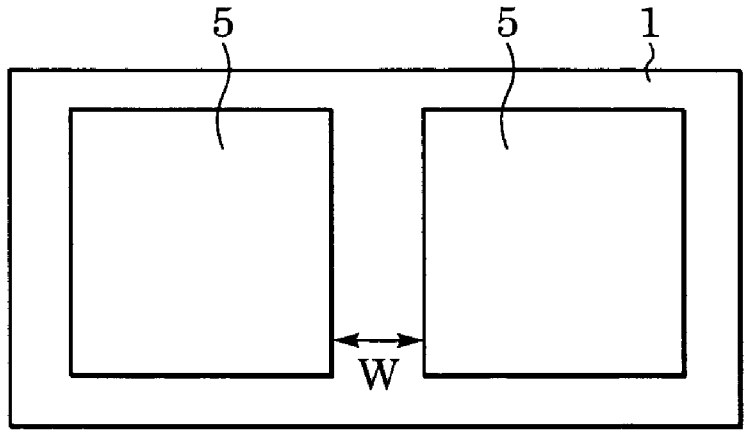

FIGS. 1A and 1B are schematic diagrams showing an embodiment (first embodiment) of an electron emission device according to the present invention. FIG. 1A is a cross-sectional view of the electron emission apparatus. Note that in FIG. 1A, an electron emission apparatus is formed by disposing an anode electrode at a location properly spaced apart from the electron emission device, and the electron emission apparatus is driven. FIG. 1B is a plan view of the electron emission device. In FIGS. 1A and 1B, reference numeral 1 denotes a substrate, reference numeral 2 denotes a cathode electrode, reference numeral 3 denotes a gate electrode serving as a control electrode, reference numeral 4 denotes an anode electrode, reference numeral 5 denotes an electron emission film, reference numeral 6 denotes a driving power supply, and reference numeral 7 denotes an anode power supply. In the electron emission apparatus, when a driving voltage Vg (volts) is applied between the cathode electrode 2 and the gate electrode 3 such that the electric potential of the gate electrode 3 is higher than that of the cathode electrode 2, and a voltage Va (volts) higher than Vg is applied between the anode electrode 4 and the cathode electrode 2, electrons are emitted from the electron emission film 5 and an electron emission current Ie [amps] flows into the anode 4.

In the present invention, a combination of the cathode electrode 2 and the electron emission film 5 as a whole may be referred to as a first conductive film having an electron emission part or simply as a first conductive film, and a combination of the control electrode (gate electrode) 3 and the electron emission film 5 as a whole may be referred to as a second conductive film having an electron emission part or simply as a second conductive film.

In the first embodiment, the first conductive film and the second conductive film are formed in same configuration. Although in this specific example, the first conductive film includes the electron emission film 5 and the cathode electrode 2 formed of different materials, the first conductive film may include only the electron emission film 5 if electrons can be emitted from the electron emission film 5 simply by supplying electrons to the electron emission film 5.

The electron emission film 5 may be a film capable of emitting, by itself, electrons when electrons are supplied to the film or may be a film that develops a function as an electron emission film when the film is connected to the surface of the cathode electrode, as in examples described later with reference to FIG. 2 or 6. That is, from the point of view of the function, it is not necessary to distinct the electron emission film from the cathode electrode, but the first conductive film is preferably composed of a plurality of layers (films) that are different in composition, and the first conductive film has an electron emission part, although in other embodiments only the single film is needed to be employed as described above.

The first conductive film (e.g., electron emission film 5) is capable of emitting electrons by applying thereto a low strength electric field. Preferably, a threshold electric field, that is, the electric field with the lowest magnitude needed to emit electrons, is lower than $1\times10^6$ V/cm (100 V/μm). A specific example of such a conductive film is a carbon film, which can be composed of carbon fiber.

Use of a carbon film allows a reduction in the driving electric field (that is applied to emit electrons) compared with a metal film. It is desirable that the carbon film be composed primarily of a carbon base material 10, as shown in FIG. 2, and a large number of conductive particles 8 contained in the carbon base material 10. The resistivity of the carbon base material 10 is set to be higher than the resistivity of conductive particles 8. To this end, in general, a dielectric material is used as the carbon base material 10 and conductive particles 8 are formed of a conductive material. Preferably, to achieve electron emission in low strength electric fields, the resistivity of the carbon base material 10 is set to be 100 or more times greater than the resistivity of conductive particles 8.

Figure 2:
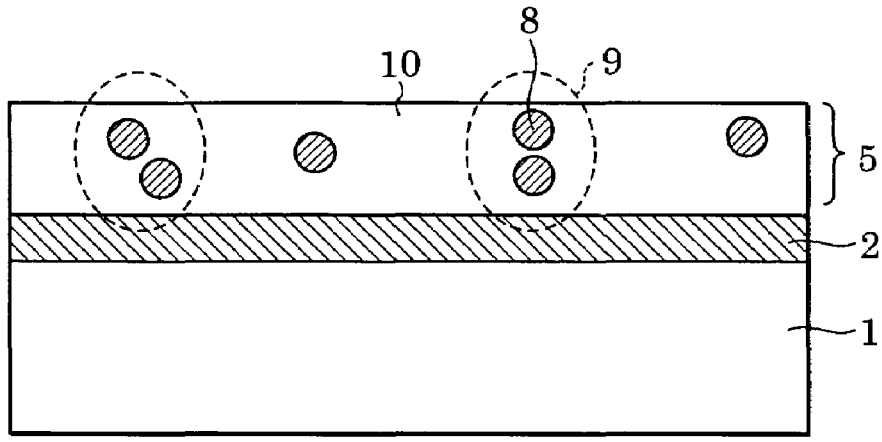
FIG. 2 is a cross-sectional view showing a carbon layer in an electron emission device according to an embodiment of the present invention.

Preferably, metal particles are used as conductive particles 8 shown in FIG. 2, and group VIII elements are preferably usable as the metal. More preferably, the metal of the conductive particles 8 is catalytic to carbon. Specifically, it is desirable that the material of the conductive particles 8 include at least one of metal selected from the group consisting of Co, Ni, and Fe. Co is most preferable. Ni, Fe, and Co have low band barrier when they are brought in contact with carbon, and thus a low barrier against electron injection can be achieved. To achieve a great emission current density, it is desirable that the above-described metal material of conductive particles 8 be in the form of a single crystal.

In the structure shown in FIG. 2, the resistivity of the carbon base material 10 is preferably in the range of $1\times10^1$ to $1\times10^{14}$ Ωcm, and more preferably, in the range of $1\times10^7$ to $1\times10^{14}$ Ωcm. It is desirable that the carbon base material 10 have an $sp^2$ bond, and more preferably that the carbon base material 10 have both $sp^2$ and $sp^3$ bonds. In particular, when the carbon layer 5 has a microscopic structure of graphite (graphene) and has a structure including a $sp^3$ bond, an excellent electron emission characteristic can be achieved even in low strength electric field concentration. If conductive particles 8 are disposed in the carbon base material 10, they cause an electric field concentration which results in a further improvement in the electron emission characteristic. Note that, as mentioned above, the resistance of the carbon layer 5 preferably should be so as high as to substantially serve as an insulating film. In this regard, it is desirable to use amorphous carbon such as diamond-like carbon (DLC) as a main ingredient of the carbon base material 10 to achieve high resistivity in the range of $1\times10^1$ to $1\times10^{14}$ Ω·cm that allows the carbon layer 5 to function substantially as a dielectric.

In the structure shown in FIG. 2, conductive particles 8 are not necessarily uniformly distributed in the carbon base material 10. On the contrary, as shown in FIG. 2, it is desirable that conductive particles 8 be in the form of groups 9 each including a plurality of conductive particles 8. The groups 9 are preferably arranged apart from each other (the groups 9 are discretely arranged in the carbon layer 5). It is desirable that the distance between groups be greater than the average thickness of the carbon layer 5. The average thickness of the carbon layer 5 is defined with respect to the surface of cathode electrode 2 or the surface of the substrate 1. Preferably, the distance between groups 9 is greater than the average thickness of the carbon layer 5, and more preferably, 1.5 to 1000 times greater than average thickness of the carbon layer 5. If the distance between groups 9 is out of the preferable range described above, the emission site density (ESD) leaves the range needed to obtain the electronic emission characteristic which is required when the electron emission device is used in the image display device.

By setting the distance between groups 9 to be sufficiently great, it becomes possible to reduce the threshold (threshold voltage) for electron emission. This is because the increase in the distance between the groups 9 causes an increase in electric field concentration. In the present invention, as shown in FIG. 2, conductive particles 8 may exist in an isolated form without belonging to any group 9.

A plurality of conductive particles 8 included in each group 9 are oriented in a direction substantially extending in the thickness direction of the carbon layer 5 (direction from the cathode electrode 2 to the surface of the carbon layer 5 or direction substantially perpendicular to a surface of the substrate 1) such that electric fields are concentrated on respective groups 9.

There is no particular restriction on the number of conductive particles 8 arranged in the direction extending across the thickness of the carbon layer 5, as long as two or more conductive particles 8 are arranged in that direction. For example, when there are two particles adjacent to each other in the direction across the thickness of the carbon layer 5, if one of these two adjacent particles is located closer to the surface of the cathode electrode 2 (or the surface of the carbon layer 5) than the other one, these two adjacent particles can be regarded to be oriented in the thickness direction of the carbon layer 5. In order to achieve a lower threshold for electron emission, it is desirable that three or more particles be arranged in the thickness direction of the carbon layer 5, and it is more desirable that these particles be arranged in a direction substantially perpendicular to the surface of the cathode electrode 2 (the surface of the carbon film 5).

It is desirable that conductive particles 8 adjacent to each other in each group 9 be located within the range of less than 5 nm from each other. If the distance between two adjacent particles exceeds the upper limit of this range, an abrupt and great increase occurs in threshold electric field (Eth) for electron emission and it also becomes difficult to obtain a sufficiently large emission current. In each group 9, adjacent particles may be in direct contact with each other. It is undesirable that adjacent particles are spaced by a distance greater than the average particle diameter, because a sufficient electric field concentration does not occur. In the present invention, even if adjacent particles in the carbon layer 5 are in direct contact with each other, a high resistance is obtained between these adjacent particles, because they are substantially in contact at a point. This suppresses an excessive increase in emission current at electron emission sites in the carbon layer 5, and thus stable electron emission can be achieved.

It is desirable that the conductive particles 8 be substantially completely embedded in the carbon layer 5, although conductive particles 8 may be partially exposed to the surface of the carbon layer 5. To this end, it is desirable that the surface roughness of the carbon layer 5 be less than one-tenth (in rms (root-mean-square)) of the average film thickness of the carbon layer 5 so that the divergence of the electron beam caused by the surface roughness of the carbon layer 5 is suppressed. In the structure described above, the surface of each conductive particle 8 is not easily affected by residual gas in vacuum, and thus stable electron emission may be achieved.

In the electron emission device constructed in the above-described manner, conductive paths are formed by conductive particles 8 at dispersed locations in the carbon base dielectric material 10. Therefore, high-performance electron emission can be realized without the carbon base material being partially destroyed or damaged. However, if the conductive particles 8 are uniformly distributed in high density over the entire carbon layer 5, the threshold electric field (Eth) for electron emission becomes high. If the distance between adjacent groups 9 is too great, it becomes impossible to obtain a minimum electron emission current needed for the electron emission device to operate in a display and it becomes impossible to achieve the minimum electron emission site density needed to achieve a stable electron emission current. As a result, it becomes impossible to obtain stable electron emission and thus impossible to stably display an image. Thus, to achieve stable electron emission in low strength electric fields, it is desirable that the density of conductive particles 8 in the carbon layer 5 be in the range of $1\times10^{14}$ particles/cm$^3$ to $5\times10^{18}$ particles/cm$^3$, and more desirably $1\times10^{15}$ particles/cm$^3$ to $5\times10^{17}$ particles/cm$^3$. For the same reason, to achieve stable electron emission in low strength electric fields, it is desirable that the concentration of the main element of conductive particles 8 relative to the main element of the carbon base material 10 is in the range from 0.001 to 1.5 atomic percent, and more desirably from 0.05 to 1 atomic percent. If the concentration exceeds the upper limit of the above-described range, as described above, the threshold for electron emission becomes high and thus a greater driving voltage becomes necessary, which can result in discharge breakdown, or a sufficiently large electron emission site density is not obtained which is required to obtain a sufficiently large emission current density needed in the image display device.

Figure 3:
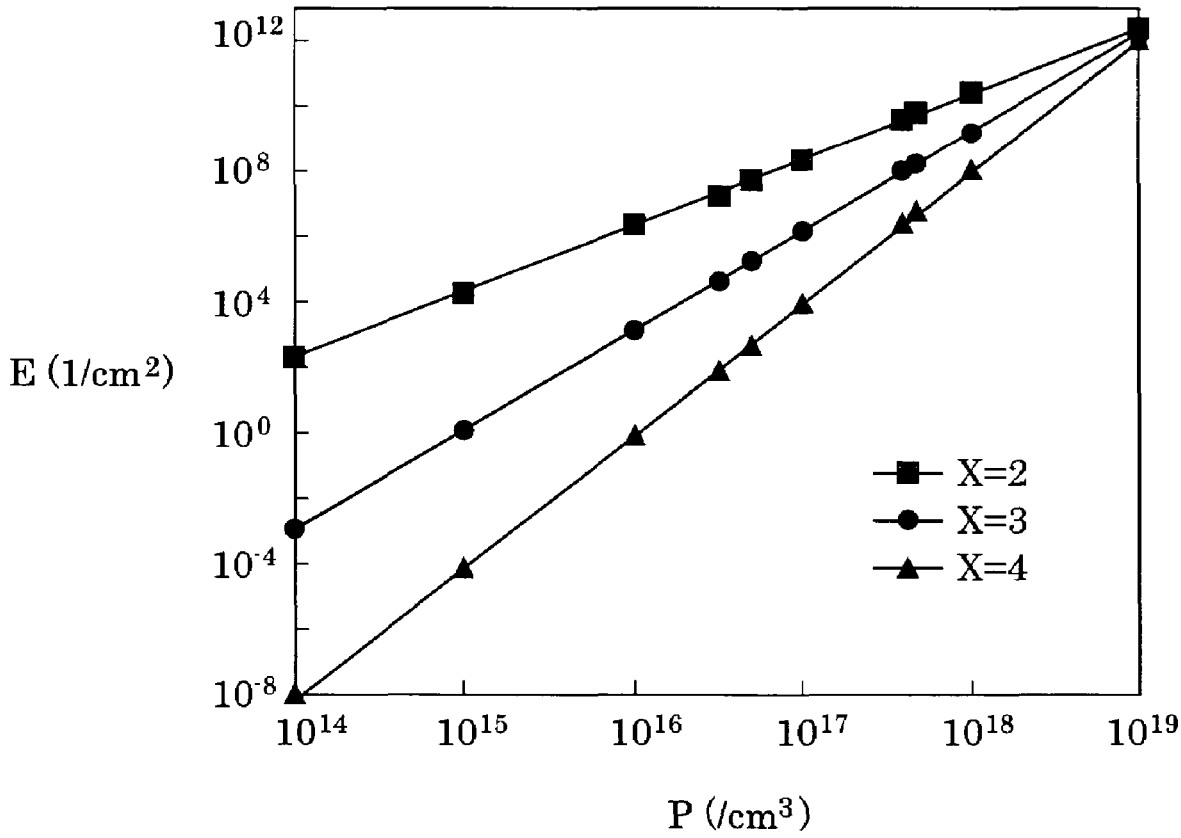
FIG. 3 is a graph showing the relationship between the density of conductive particles in a carbon layer of an electron emission device and the number of particle groups.
Figure 4:
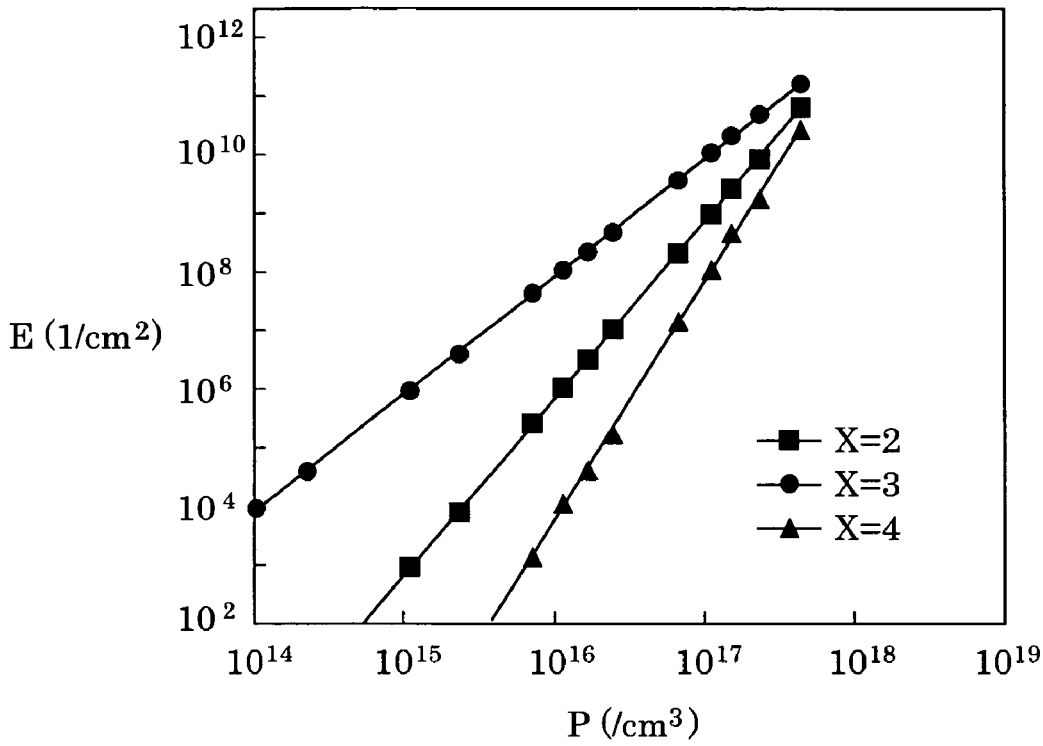
FIG. 4 is a graph showing the relationship between the density of conductive particles in a carbon layer of an electron emission device and the number of particle groups.

The allowable ranges of the parameters are described in further detail below. FIGS. 3 and 4 show the number of groups 9 contained in the carbon layer 5 per square centimeter as a function of the density of conductive particles 8. In these figures, X denotes the number of conductive particles 8 included in one group 9.

If the density of the conductive particle 8 in the carbon layer 5 is denoted by P (particles/cm$^3$), where P denotes the number of particles 8 per cubic centimeter, the film thickness of the carbon layer 5 is denoted by h, and the average radius of conductive particle 8 is denoted by $r_{cp}$, then the number, E, of groups 9 each including a plurality of conductive particles 8 existing in the carbon layer 5 per square centimeter is given by $2r_{cp}P(8r_{cp}{}^3P)^{(h/2r-1)}$ groups/cm$^2$. FIG. 3 is a graph representing the number of groups as a function of the density of conductive particles 8 for $r_{cp}$=2 nm, and FIG. 4 is a graph for $r_{cp}$=5 nm. The average radius of conductive particles 8, r, is preferably in the range from 1 nm to 10 nm, as will be discussed in detail later.

It is desirable to obtain as great a value of E as possible by setting P within the range in which a sufficiently high electric field concentration on groups 9 occurs. In order to obtain sufficiently high electric field concentration, it is required that each group 9 include two or more conductive particles 8 arranged in the direction across the thickness of the carbon layer 5 and that the number, E, of groups 8 be greater than $1\times10^2$ groups/cm$^2$ and more preferably greater than $1\times10^4$ particles/cm$^2$. To satisfy this requirement, P should be set to be greater than $1\times10^{14}$ groups/cm$^2$, for $r_{cp}$=2 nm. To obtain E greater than $1\times10^4$ groups/cm$^2$ for $r_{cp}$=5 nm, P should be set to be greater than $1\times10^{14}$ particles/cm$^3$. On the other hand, when P exceeds $5\times10^{18}$ particles/cm$^3$, the number of conductive particles 8 becomes too great, and the carbon layer 5 becomes a mere conductive material and no electric field concentration on groups 9 occurs. As a result, the ESD decreases and thus the current density decreases. Thus, good electron emission characteristic cannot be obtained.

The preferable range of P depends on the thickness of the carbon layer 5 and the size of conductive particles 8. When the size of conductive particles 8 is controlled to be on the order of a few nm and the thickness of the carbon layer 5 is equal to a few ten nm, the preferable range of P is $1\times10^{14}$ particles/cm$^3$ to $5\times10^{18}$ particles/cm$^3$. In a case in which the average particle diameter (2r) of conductive particles 8 is 1 to 10 nm and the main element of the conductive particles 8 is Co, the requirement described above is satisfied when the concentration of Co in the carbon layer 5 is in the range of 0.001 to 1.5 atomic percent. The most preferable range of P is $1\times10^{15}$ particles/cm$^3$ to $5\times10^{17}$ particles/cm$^3$. To obtain P in this most preferable range in the example shown in FIG. 3 for the case in which each group 9 includes two or more conductive particles 8, the number E of groups 9 should be in the range from $1\times10^4$ groups/cm$^2$ to $1\times10^{10}$ groups/cm$^2$.

Figure 5:
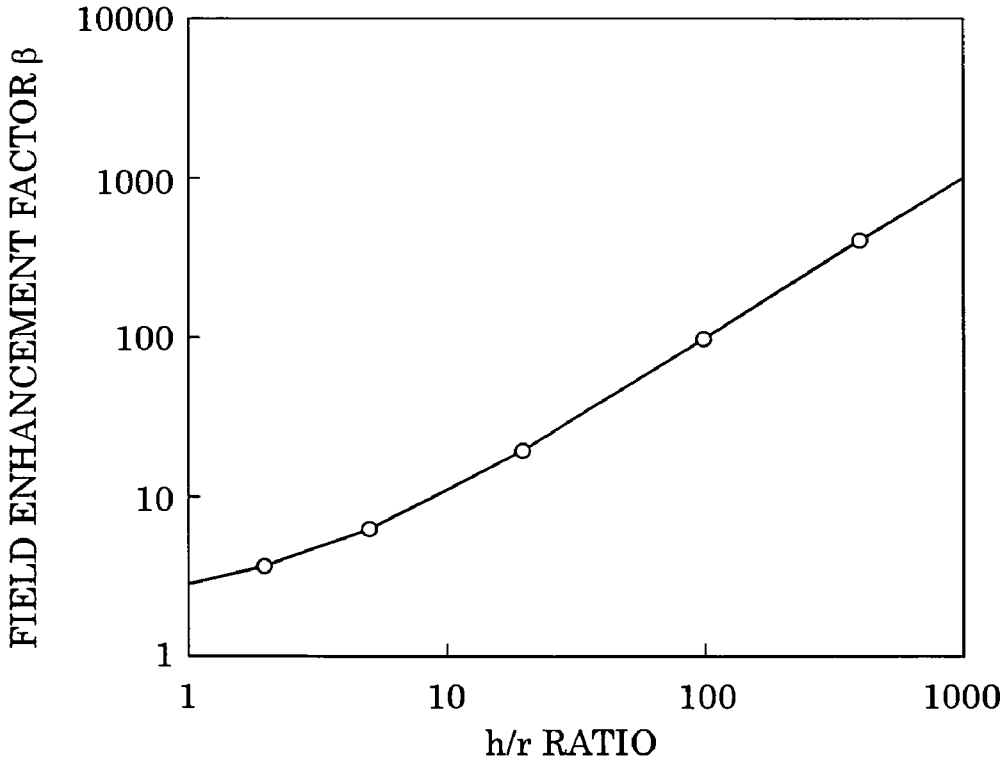
FIG. 5 is a diagram showing the relationship between the h/r ratio and the electric field enhancement factor β of a carbon layer of an electron emission device according to the present invention.

The electric field concentration is further discussed with reference to FIG. 5. When the height of a conduction path is h and the radius of the electron emission part is r, the electric field concentrates by a factor of $(2+h/r_{cp})$. A further electric field concentration by a factor of β (field concentration enhancement factor) can occur depending on the microscopic structure of the top of the electron emission part. Thus, the overall electric field concentration factor is given by $(2+h/r_{cp})\beta$. This great electric field concentration factor obtained in the structure described above makes it possible to easily emit electrons from the electron emission film.

The shape of the electron beam emitted from the electron emission film depends on the thickness of the carbon layer 5, the size and the shape of the conductive particles 8, and the electric field. When the thickness of the carbon layer 5 is less than 100 nm, the electron beam has a desirable non-divergent shape. When the thickness of the carbon layer 5 is in this range, there is little structural stress and thus this range is also preferable from the point of view of the thin film process. If the particle size of the conductive particles 8 is increased and the thickness of the carbon layer 5 is increased in proportion to the particle size, the distance between groups 9 becomes large and the electron emission side density decreases. When the carbon layer 5 has a thickness less than 100 nm, the preferable particle size of the conductive particles 8 is several nm (typically 1 nm to 10 nm) and it is desirable that each group 9 includes a few conductive particles 8 arranged in a direction from the cathode electrode 2 to the surface of the carbon layer 5.

To reduce the stress of the carbon layer 5, it is desirable to incorporate hydrogen into the carbon layer 5. In general, a film mainly composed of carbon, such as a DLC (diamond like carbon) film, has high hardness and high stress, and thus the film is not easy to process. Even when the film is excellent as the electron emission film, it is difficult to use such a film having high hardness and high stress to form the electron emission device or the electron source, because of the difficulty with processing. Thus, it is desirable to reduce the stress of the film by incorporating hydrogen into the film such that the film can be easily handled in the production process. Preferably, to reduce the stress and the hardness (modulus of elasticity), hydrogen is incorporated into the carbon layer 5 to a concentration of 0.1 atomic percent or greater with respect to the concentration of carbon and more preferably greater than 1 atomic percent. However, if the ratio of the concentration of hydrogen to that of carbon is greater than 20 atomic percent, degradation in electron emission characteristic occurs, and thus the practical upper limit on the concentration of hydrogen is 20 atomic percent.

Figure 6:
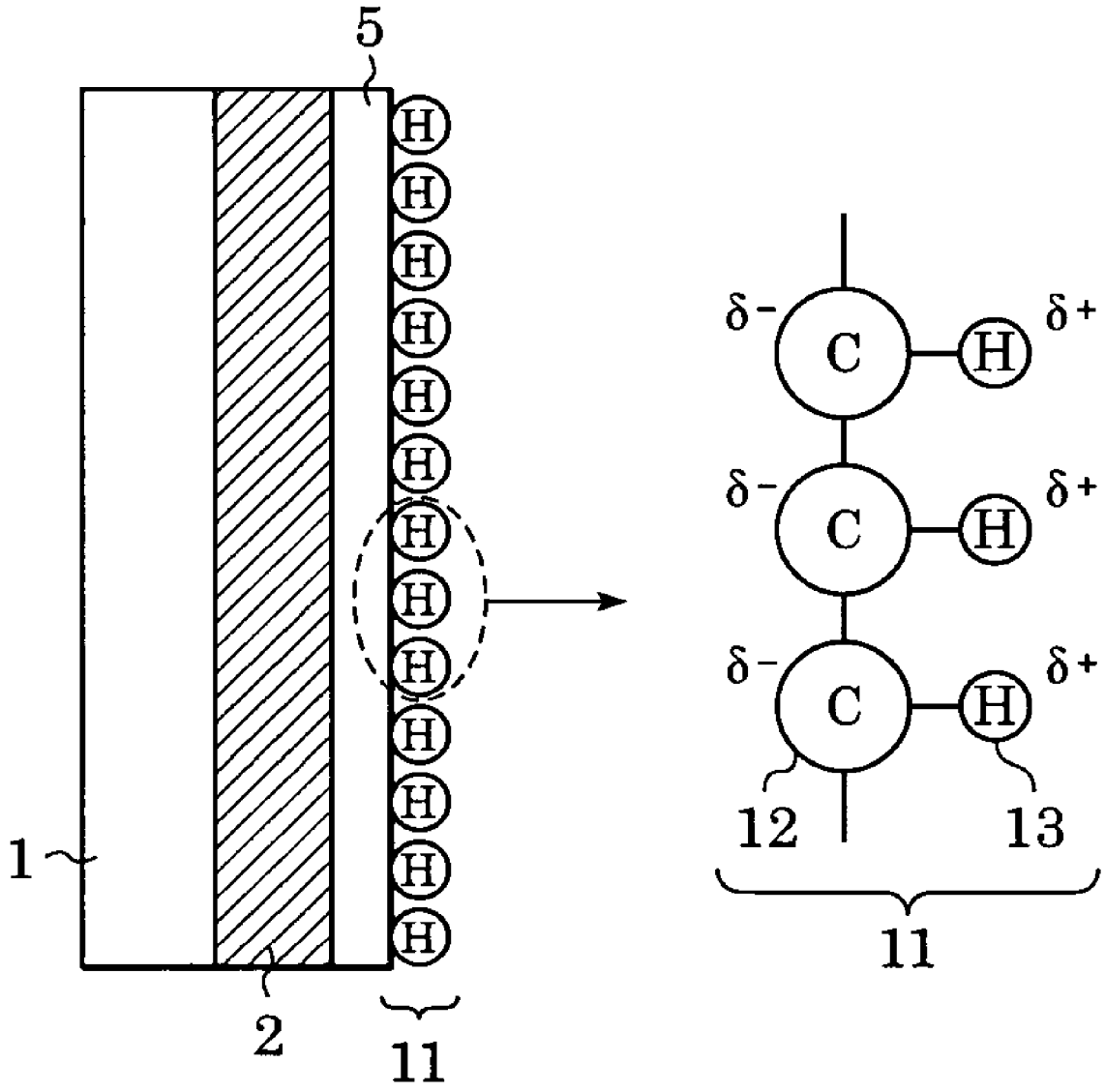
FIG. 6 is a schematic diagram showing a structure of a carbon layer having a dipole layer employable in the present invention.

FIG. 6 shows a desirable example of a carbon layer 5 according to the present invention. In this example, a carbon layer 5 is disposed on a surface of a cathode electrode 2, and a dipole layer 11 is formed on the surface of the carbon layer 5. In FIG. 6, numeral 1 denotes a substrate, and numeral 11 denotes the dipole layer. In this structure, it is desirable that the resistivity of the carbon layer 5 be in the range of $1\times10^1$ to $1\times10^{14}$ Ωcm, and more preferably, in the range of $1\times10^7$ to $1\times10^{14}$ Ωcm.

In this example, the surface (exposed to vacuum) of the carbon layer 5 is terminated with hydrogen. The surface terminated with hydrogen functions as a dipole layer 11. The material for forming the dipole layer 11 (material for terminating the surface) is not limited to hydrogen. Any material that can reduce the energy level of the surface of the carbon layer 5 in a state in which no voltage is applied between the cathode electrode 2 and the extraction electrode (the gate electrode and/or the anode electrode) may be used to terminate the surface of the carbon layer 5. A preferable example of such material is hydrogen. In general, hydrogen atoms 13 are slightly polarized positively (δ+), and thus atoms (carbon atoms 12 in this case) on the surface of the carbon layer 5 are slightly polarized negatively (δ−). As a result, the dipole layer (electric double layer) 11 is formed.

Figure 7A:
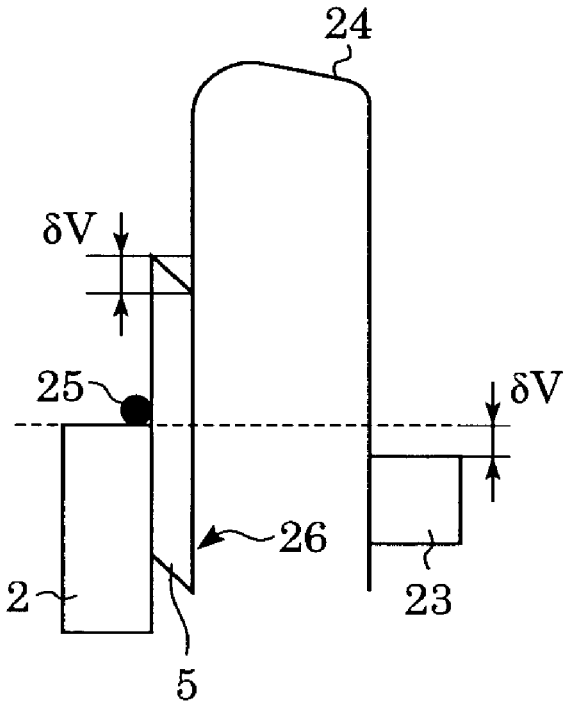
FIGS. 7A and 7B are schematic diagrams showing the principles of electron emission from the carbon layer shown in FIG. 6.
Figure 7B:
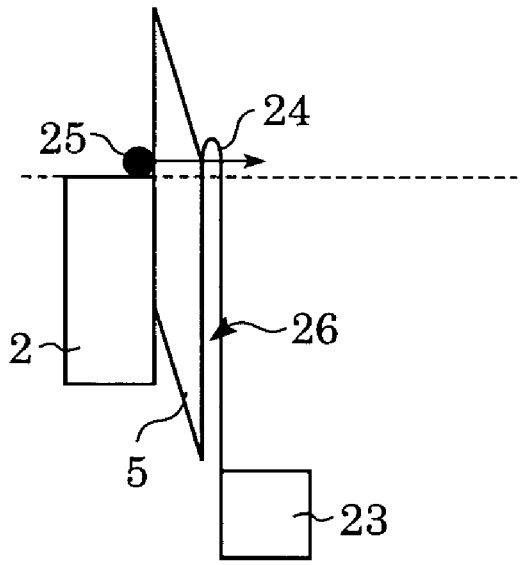

The principle of electron emission from the first conductive film having the dipole layer 11 is described below with reference to a band diagram shown in FIGS. 7A and 7B. FIG. 7A shows an energy band diagram in a state in which no voltage is applied to the extraction electrode 23, and FIG. 7B shows an energy band diagram in a state in which a voltage is applied to the extraction electrode 23. Herein, the extraction electrode refers to the gate electrode, the anode electrode, or the combination of the gate electrode and the anode electrode. In FIGS. 7A and 7B, 2 denotes the cathode electrode, 5 denotes the carbon layer (insulating layer), 23 denotes the extraction electrode, 24 denotes a vacuum barrier, 25 denotes electrons, and 26 denotes the interface between the surface of the insulating layer on which the dipole layer is formed and a vacuum.

In a state in which no external driving voltage is applied between the cathode electrode 2 and the extraction electrode 23 in the state shown in FIG. 7A, the existence of the dipole layer results in a potential distribution on the surface of the insulating layer, equivalent to that obtained when a voltage equal to the dipole voltage δ is externally applied.

As shown in FIG. 7B, if a driving voltage V (volts) is applied between the cathode electrode 2 and the extraction electrode 23, the potential of the carbon layer 5 is pulled down and, as a result, the vacuum barrier 24 decreases. If the thickness of the carbon layer 5 is set to a proper value (preferably, less than 10 nm) that allows tunneling through the carbon layer 5 to occur when the driving voltage V (volts) is applied, it is possible to reduce the spatial distance across the carbon layer 5 to a level that allows electrons 25 supplied from the cathode electrode 2 to tunnel through the carbon layer 5. Then an electron emission to vacuum is realized.

As a material with which to terminate the surface of the carbon layer 5, it is desirable to employ a material that reduces the surface state (energy level) of the carbon layer 5 by 0.5 eV or greater and more desirably 1 eV or greater in a state in which no voltage is applied between the cathode electrode 2 and the extraction electrode 23. In the electron emission device according to the present invention, the surface state of the carbon layer 5 has to exhibit a positive electron affinity regardless of whether a driving voltage is applied between the cathode electrode 2 and the extraction electrode 23.

The thickness of the carbon layer 5 is determined depending on the driving voltage. In general, the thickness of the carbon layer 5 is preferably set to 20 nm or less and more preferably to 10 nm or less. The lower limit of the thickness of the carbon layer 5 is determined by the minimum thickness that allows electrons to pass through the carbon layer 5 by tunneling in a state in which the electron emission device is operated. In practice, the reproducibility of forming the carbon layer (insulating layer) 5 has to be taken into account, and thus the practical lower limit is about 1 nm.

In the electron emission device according to the present invention, as described above, the positive electron affinity of the carbon layer 5 ensures that the electron emission device has a distinct on/off ratio in terms of the electron emission amount, that is the ratio of the electron emission amount in the selected state (on-state) of the electron emission device to that in the non-selected state (off-state).

The carbon layer 5 shown in FIG. 6 may contain conductive particles 8 such as those described earlier with reference to FIG. 2. Conversely, the dipole layer 11 shown in FIG. 6 may be formed on the surface of the carbon layer 5 shown in FIG. 2.

Now, an example of a production process according to the present invention is described with reference to FIGS. 8A-8E. One of remarkable features the present invention is that the production process includes a characteristic adjustment step is.

The production process of the electron emission device according to the present invention includes a step of forming a cathode electrode and a control electrode on a substrate, and a step of depositing an electron emission film. The order of these two steps is reversible.

Step 1

Figure 8A:
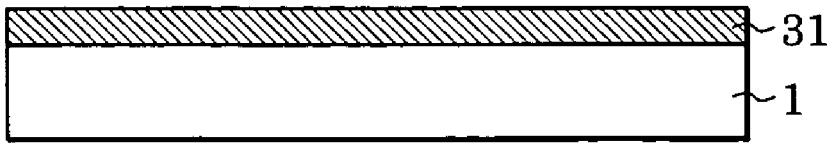
FIGS. 8A to 8E illustrate an example of a process of producing an electron emission device according to the present invention.

First, an insulating substrate 1 made of quartz glass, glass including a low concentration of impurities such as Na, soda-lime glass, a multilayer substrate whose top layer is a $SiO_2$ layer, or ceramic is prepared. After the surface of the substrate 1 is well cleaned, a conductive film 31 (which will be formed later into a cathode electrode 2 and a control electrode 3) is formed on the surface of the substrate 1 (FIG. 8A).

The conductive film 31 may be formed using a common vacuum film formation technique such as an evaporation method or a sputtering method. The material of the conductive film 31 may be selected from metal materials such as Be, Mg, Ti and Zr, Hf, V, Nb, Ta, Mo, W, Al, Cu, Ni, Cr, Au, Pt, and Pd or an alloy thereof. The thickness of the conductive film 31 is set within the range from 10 nm to 100 μm and more preferably within the range from 100 nm to 1 μm.

Step 2

Figure 8B:
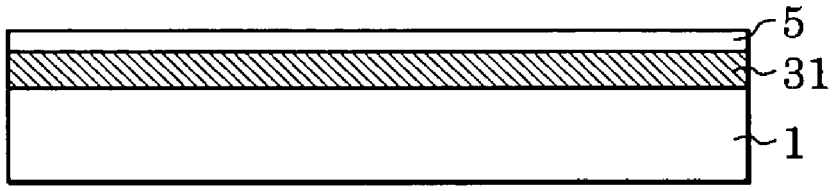

Subsequently, as shown in FIG. 8B, a carbon layer 5 is formed on the conductive film 31.

It is desirable that the carbon layer 5 have good flatness. More specifically, it is preferable that the surface roughness of the carbon layer 5 be less than one-tenth (in rms) of the average film thickness of the carbon layer 5 or less than 10 nm (in rms) and more preferably less than 1 nm. However, the better the flatness, the less the electric field enhancement effect of sharp points and thus the greater the threshold electric field. To obtain a sufficiently low threshold electric field for the carbon layer 5 having such a flat surface, use of a special structure such as that used in the carbon layer 5 shown in FIG. 2 or 6 is effective. Note that the roughness of the surface is expressed in rms, that is, the root mean squares of deviations of the curved surface from the average line. This expression of surface roughness is also used in the JIS standards.

Step 3

Figure 8C:
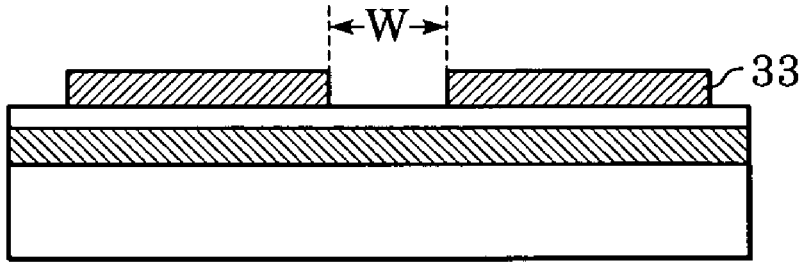

A photoresist pattern 33 to be used as a mask in an etching process for forming the cathode electrode 2 and the control electrode 3 is formed by means of photolithography (FIG. 8C).

Step 4

Figure 8D:
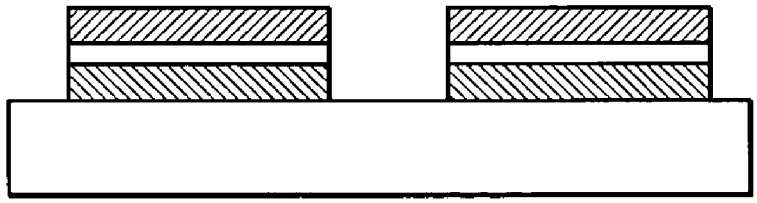
Figure 8E:
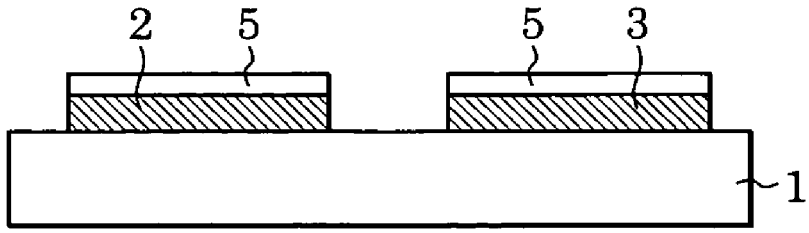

Subsequently, the conductive film 31 and the carbon layer 5 are etched so as to form the cathode electrode 2 and the control electrode 3 (FIG. 8D). It is desirable that the conductive film 31 and the carbon layer 5 be etched such that a flat etched surface is obtained. A proper etching method, such as dry etching or wet etching, may be used depending on the materials of the conductive film 31 and the carbon layer 5.

Step 5

The mask 33 is the removed. As a result, a structure shown in FIG. 8E (FIGS. 1A and 1B) is obtained.

The space W (shown in FIGS. 1A and 1B) between the cathode electrode 2 and the control electrode 3 is determined depending on the materials of which the electron emission device is composed, the resistance of the materials, the electrical characteristics of the carbon layer 5, and the shape of the electron emission beam to be emitted. In general, W is preferably set within the range from 10 nm to 100 μm.

The reduction in the space W is a most effective means to reduce the driving voltage of the electron emission device. From this point of view, it is desirable that the space W be set to be less than 10 μm. However, too large a reduction in the space W can result in a reduction in electron emission efficiency of the electron emission device, because, a very small space W can cause some of the electrons emitted from the cathode electrode 2 to collide with the control electrode 3 (gate electrode) and to be absorbed by the control electrode 3 before reaching the anode electrode.

In general, a significant reduction in electron emission efficiency occurs when the space W is less than 100 nm, although the value of the space at which the reduction in electron emission efficiency starts depends on the driving voltage and the shape of the device, such as the thickness of the electrodes, and the emission material.

Thus, in the present embodiment, it is more preferable that the space W be set within the range from 100 nm to 10 μm.

As required, post processing may be performed to enhance the capability of emitting electrons. Examples include annealing and plasma processing. In the case in which a surface termination layer (dipole layer) is formed such as that shown in FIG. 6, it is preferable that the post processing be performed at this stage.

Step 6

Subsequently, the characteristic adjustment process, which is one features of the present invention, is performed.

In the characteristic adjustment process, threshold electric fields are adjusted such that $E_{th_reverse} > E_{th_forward}$ where $E_{th_forward}$, called the forward threshold electric field strength, is the minimum electric field strength needed to cause the emission of electrons from the first conductive film (cathode electrode) when the electric field is applied in a forward direction, and $E_{th_reverse}$, called the reverse threshold electric field strength, is the minimum electric field strength needed to cause the emission of electrons from the second conductive film (control electrode) when the electric field is applied in a reverse direction.

The "forward direction" refers to a direction of the electric field that causes the potential of the cathode electrode (the first conductive film) to be lower than the potential of the electrode (the control electrode (the second conductive film) and/or the anode electrode) which produces an electric field for extracting electrons from the cathode electrode (the first conductive film). On the other hand, the "reverse direction" refers to a direction of the electric field that causes the potential of the cathode electrode (the first conductive film) to be higher than the potential of the electrode (the control electrode (the second conductive film) and/or the anode electrode) which produces an electric field for extracting electrons from the cathode electrode (the first conductive film).

One of techniques usable in the characteristic adjustment process is to increase the threshold electric field (threshold voltage) in the reverse direction by applying an electric field (voltage) only in the reverse direction thereby achieving $E_{th_reverse}>E_{th_forward}$. Another technique is to increase the threshold electric field $E_{th}$ (threshold voltage $V_{th}$) in both forward and reverse directions so as to achieve $E_{th_reverse}>E_{th_forward}$. Any of these techniques may be used in the characteristic adjustment process.

If the second technique described above is performed, the electron emission characteristic (I-V characteristic, that is, the relationship between the voltage V applied to emit electrons and the resultant emission current I) in the driving state is controlled. This technique can be used, for example, to adjust the electron emission characteristic of a large number of electron emission devices arranged in an electron source or in an image display device such that they have similar characteristics. One specific adjustment technique to obtain a similar characteristic for all electron emission devices is to detect the highest threshold electric field of those of all electron emission devices and adjust the threshold electric field of the other electron emission devices to the detected highest threshold electric field. Another technique is to increase the threshold electric field of specific electron emission devices (typically, all the electron emission devices) to a particular value. From the point of view of the production cost, the second technique is more preferable, because it is simpler than the first technique. Note that in the present invention, it is not needed to make the adjustment such that the I-V characteristic becomes perfectly the same for all devices. It is sufficient to make the adjustment such that the I-V characteristics of the electron emission devices are substantially equal to each other for a voltage range that is applied to the devices in the actual operation.

In the present invention, the method of achieving $E_{th_reverse}>E_{th_forward}$ is not limited to those described above in which a voltage is applied to electron emission devices.

One of specific techniques to increase the threshold electric field is to apply a maximum electric field $E_{max}$ to the electron emission film 5 (the first conductive film and/or the second conductive film). Herein, the "maximum electric field" refers to an electric field higher than any electric field which has been applied to the electron emission film 5 (the first conductive film and/or the second conductive film) before the characteristic adjustment process. Note that this does not imply that it is needed to apply an electric field to the electron emission film 5 (the first conductive film and/or the second conductive film) before the characteristic adjustment process. Preferably, in the present invention, the characteristic adjustment process includes a step in which electrons are emitted from the electron emission film 5 (the first conductive film and/or the second conductive film).

The electric field applied (in the forward direction) to the electron emission film (the first conductive film and/or the second conductive film) to drive the electron emission device or the electron emission apparatus (the electric field applied to the electron emission film in actual operation of the electron emission device or the electron emission apparatus) is determined depending on the structure of the electron emission device or the electron emission apparatus and also depending on the driving state and the driving voltage, and furthermore on the position of the electron emission film.

When an electron emission apparatus having a three-terminal structure (a structure including a cathode electrode, a control electrode, and an anode electrode) is driven, the electric field applied (in the forward direction) to the electron emission film (the first conductive film and/or the second conductive film) is mainly determined by Ea and Eg. The average electric field ($Ea_{av}$ (volts/μm) applied between the electron emission device and the anode electrode 4 can be expressed by the anode voltage Va (volts) (typically defined as the voltage difference between the potential of the cathode 2 and the potential of the anode electrode 4) and the distance H (μm) between the cathode electrode 2 (or the electron emission film 5) and the anode electrode 4 as $Ea_{av}=Va/H$ (volts/μm).

The average electric field ($Eg_{av}$ (volts/μm) applied between the cathode electrode 2 and the control electrode 3 can be expressed by the voltage Vg (volts) applied between the cathode electrode 2 and the control electrode 3 and the distance W between the cathode electrode 2 (or the carbon layer 5) and the control electrode 3 as $Eg_{av}=Vg/W$ (volts/μm).

In practice, Ea and Eg vary depending on the structure and the position of the electron emission device (electron emission film). Thus, actual values of Ea and Eg are given as $Ea=\beta_a\times E_{av}$ and $Eg=\beta_g\times Eg_{av}$, respectively, where $\beta_a$ and $\beta_g$ are electric field enhancement factors equal to or greater than 1. When the anode electrode 4 is disposed in a position parallel to the substrate of the electron emission device, $\beta_a\approx 1$. On the other hand, $\beta_g$ varies greatly depending on the structure of the electron emission device. In an extreme case, $\beta_g$ can be as great as a few thousands, depending on whether the electron emission part has sharp points. In the structure of the electron device using the electron emission film with a comparatively flat surface, $\beta_g$ is rather small, although it can become a few times greater than the usual value depending on the structure.

In the case of an electron emission device of the Spindt type or of the surface conduction type, the control electrode functions as an electrode for extracting electrons, and $Eg_{av}>>Ea_{av}$ in a state in which the electron emission device or the electron emission apparatus performs an actual driving operation. That is, the electric field applied to the electron emission part is dominated by the electric field (Eg) formed by the voltage applied between the control electrode 3 and the cathode electrode 2, and Ea has substantially no or very small contribution.

In the electron emission device or the electron emission apparatus having the three-terminal (triode) structure (including the cathode electrode, the control electrode, and the anode electrode), the electric field needed to extract electrons from the cathode electrode (the first conductive film) is determined by: (1) the difference between the potential of the cathode electrode 2 (the first conductive film) and the potential of the control electrode 3 (the second conductive film) (the electron emission from the cathode electrode (the first conductive film) is controlled by the potential of the control electrode (the second conductive film)), (2) the difference between the potential of the cathode electrode 2 (the first conductive film) and the potential of the anode electrode 4 (the electron emission from the cathode electrode (the first conductive film) is controlled by the potential of the anode electrode, while the control electrode (the second conductive film) serves to control the electron emission intensity or stop electron emission), or (3) the relation among the potential of the cathode electrode 2 (the first conductive film), the potential of the control electrode 3 (the second conductive film) and the potential of the anode electrode 4 (the electron emission from the cathode electrode (the first conductive film) is determined by both the electric potential of the anode electrode and the electric potential of the control electrode (the second conductive film) . Note that the present invention is not limited to the three-terminal structure (triode structure).

In the characteristic adjustment process according to the present invention, in the case of (1), the electric field in the reverse direction is given by the electric field formed in a state in which the potential of the cathode electrode is higher than the potential of the control electrode. In the case of (2), the electric field in the reverse direction is given by the electric field formed in a state in which the potential of the cathode electrode is higher than the potential of the anode electrode. In the case of (3), the electric field in the reverse direction is given by the electric field formed in a state in which the potential of the cathode electrode is higher than at least one of the potential of the anode electrode and the potential of the control electrode (desirably, higher than both the potential of the anode electrode and the potential of the control electrode).

That is, in the characteristic adjustment process according to the present invention, in any case, the electric field in the reverse direction is applied to the control electrode (the second conductive film). The application of the electric field to the control electrode (the second conductive film) in the reverse direction is effective in particular to control the electron emission characteristic of the electron emission device in which the electron emission film (or a material constituting the electron emission part) is intentionally or unintentionally formed on the control electrode. In the simplest case, the electric field in the reverse direction is similar in distribution to the maximum electric field applied to the control electrode in the state in which the electron emission device is driven (the maximum electric field applied to the actual operation). Note that the requirement of similarity is not very strict, but being approximately similar is sufficient. That is, a slight difference in electric field vector is allowable.

The application of the reverse electric field in this step causes an increase in the electric field strength ($E_{th_reverse}$) needed to emit electrons from the control electrode (the second conductive film). This increases the number of methods of applying a voltage to the electron emission device during an actual operation (in driving). In the electron source or the image display device, the increase in the reverse threshold electric field $E_{th_reverse}$ makes it possible to suppress electron emission from non-selected electron emission devices and also makes it possible to precisely control the intensity of electron emission from selected electron emission devices. Thus, crosstalk among electron emission devices is suppressed, and displaying of a high-quality image is achieved.

It is desirable that when an electric field is applied in the reverse direction during an actual operation (in driving), electrons not be emitted from the control electrode (the second conductive film). This is achieved by applying the reverse electric field during the characteristic adjustment process such that the threshold electric field needed to emit electrons from the second conductive film (control electrode) is increased to a value greater than the maximum reverse electric field that is applied during an actual operation thereby preventing electrons from being unintentionally emitted from the control electrode during an actual operation.

In this characteristic adjustment process, in addition to the increasing of $E_{th_reverse}$, it is desirable to adjust the threshold electric field ($E_{th_forward}$) needed to emit electrons from the first conductive film (the electron emission film on the cathode electrode) during an actual operation, by applying an electric field to the first conductive film in the forward direction, such that the device-to-device variation in the threshold electric field, which occurs in production of electron emission devices (electron sources) is suppressed. In the simplest case, the electric field in the forward direction is similar in distribution shape to the driving electric field that is formed during an actual operation to extract electrons from the cathode electrode (first conductive film). In order to achieve high stability and good reproducibility of the electron emission characteristic during an actual operation (in driving), it is desirable that the forward electric field $E_{th_forward}$ applied for the adjustment be not only similar in distribution shape but also greater in strength than the driving electric field applied during an actual operation. Note that the requirement of similarity is not very strict, but being approximately similar is sufficient. That is, a slight difference in electric field vector is allowable.

In the characteristic adjustment process, when the adjustment electric field is applied, electron emission from the second conductive film (the control electrode) (and also from the first conductive film (the cathode electrode)) occurs effectively. In this sense, the characteristic adjustment process may also be referred to as a process of emitting electrons from the second conductive film (and also from the first conductive film) (by a maximum emission current $I_{max}$).

This characteristic adjustment process may also be effectively regarded as a process of applying a voltage (a maximum voltage $V_{max}$) between electrodes of the electron emission device or the electron emission apparatus to emit electrons from the second conductive film (the control electrode) (and also from the first conductive film (the cathode electrode) for adjustment of the electron emission characteristic thereof. From the point of view of controllability, it is simplest to perform the characteristic adjustment process by controlling the voltage, and thus this is most preferable. In the case in which the characteristic adjustment process is controlled by controlling the applied voltage value, it is desirable that the relative position between the cathode electrode and the electrode (control electrode and/or the anode electrode) for forming the electric field to extract electrons from the first conductive film be the same as the relative position in actual operation. To this end, it is desirable to place electrodes such that at least the relative position between the cathode electrode and the control electrode becomes the same as the relative position in actual operation. When electrodes are placed at the same relative positions as in actual operation, and the characteristic adjustment process is controlled by controlling the applied voltage, it is desirable to apply the voltage between the electrodes (between the cathode electrode and the control electrode (and the anode electrode)) such that the forward or reverse electric field formed by the voltage becomes similar in distribution shape to that formed during an actual operation of the device or apparatus.

Although the electron emission device has a symmetric structure and a symmetric electron emission characteristic at the stage immediately after completion of production via steps (1) to (5) described above, an effectively asymmetric structure (i.e., an asymmetric electron emission characteristic) is obtained by simply performing the characteristic adjustment process described above. In a case in which the electron emission device is produced via steps (1) to (5) so as to have an asymmetric structure, for example, by adding the patterning step (for example, so at to form the electron emission film only on the cathode electrode), performing of the characteristic adjustment process ensures that the electron emission device has an asymmetric electron emission characteristic even if a residue remains unintentionally on the control electrode. Note that a slight or invisible microscopic change in structure can cause a change in its electric emission characteristic.

A specific example of the characteristic adjustment by applying voltages to the electron emission device according to the present invention is described below with reference to FIGS. 9A to 9C and FIG. 10. Note that this characteristic adjustment process is one of the remarkable features of the present invention.

Figure 9A:
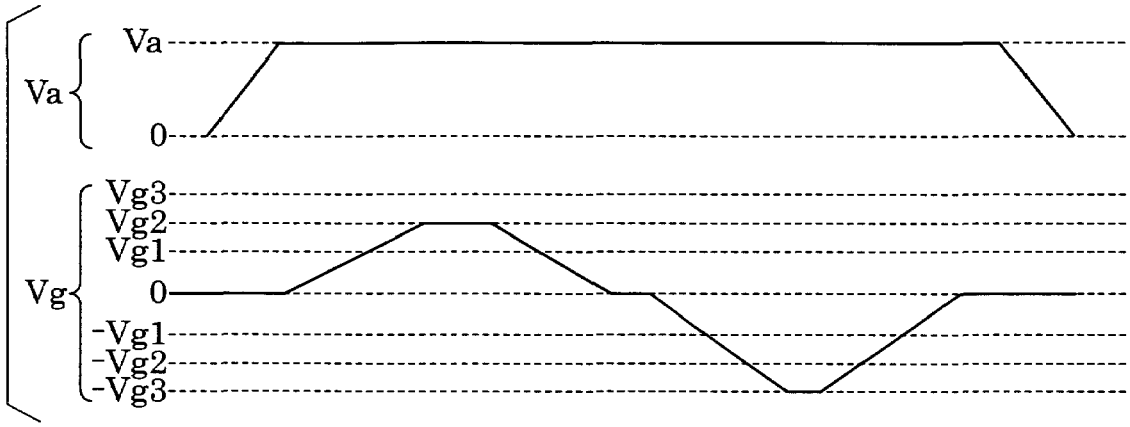
FIGS. 9A to 9C illustrate graphs showing examples of the manners in which voltages are applied to an electron emission device in a characteristic adjustment step and in an actual operation, according to the present invention.
Figure 9B:
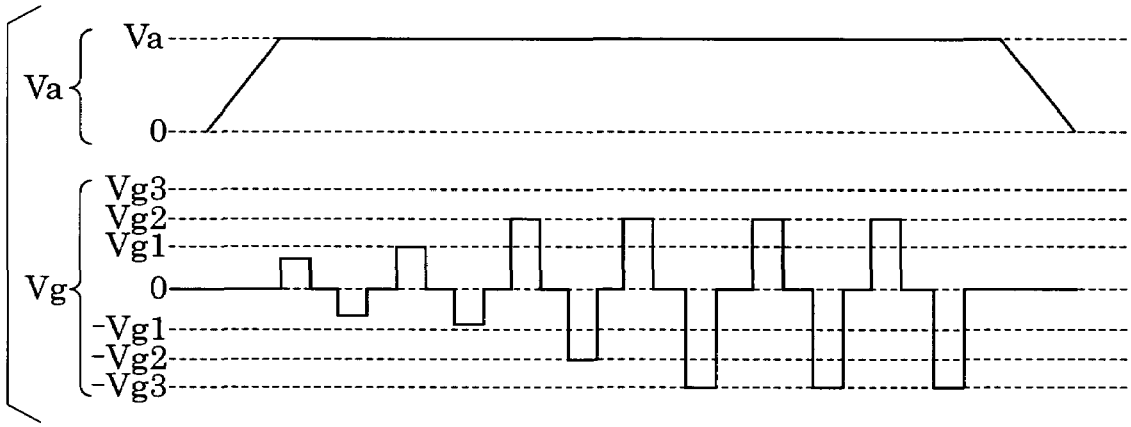

FIGS. 9A and 9B show examples of manners in which the maximum voltage $V_{max}$ is applied between the cathode electrode and the control electrode in the characteristic adjustment process.

Figure 9C:
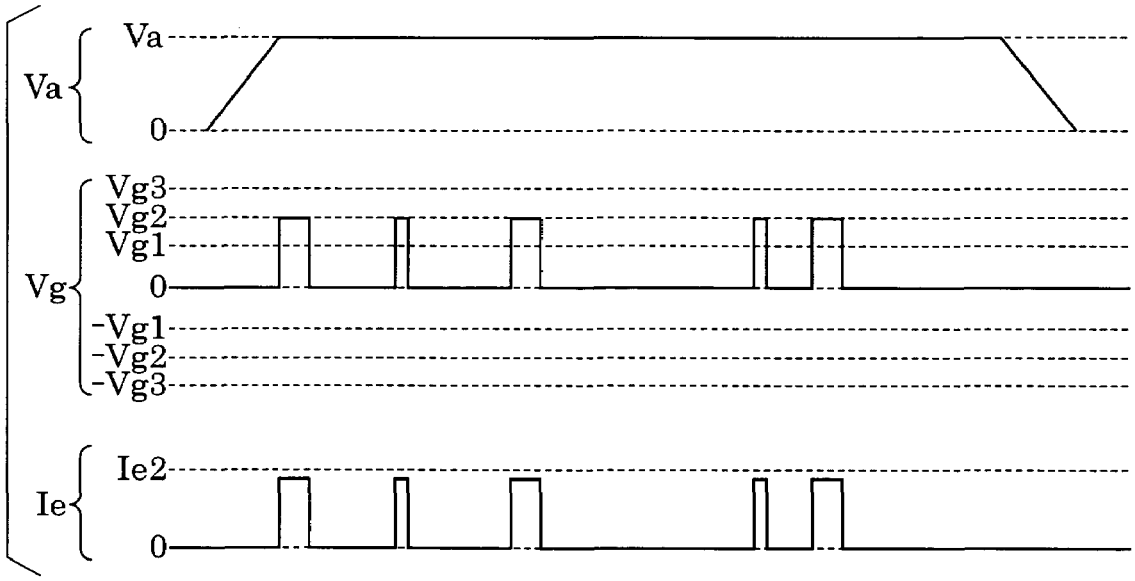

FIG. 9C shows an example of a manner in which the electron emission apparatus is driven after completion of the characteristic adjustment process.

In the examples shown in FIGS. 9A and 9B, while maintaining the anode voltage applied to the anode electrode 4 at Va (volts), the forward voltage Vg (volts) applied between the cathode electrode 2 and the control electrode 3 is gradually increased up to $Vg_2$. After the forward voltage Vg (volts) is maintained for a particular period, the forward voltage Vg (volts) is reduced down to 0. Subsequently, a reverse voltage −Vg is applied while lowering to $-Vg_3$ via $-Vg_2$.

In the example shown in FIG. 9A, the voltage is applied quasi statically. On the other hand, in the example shown in FIG. 9B, the voltage is applied in the form of a sequence of pulses. In the example shown in FIG. 9A, the voltage is first applied in the forward direction, and after completion of the application in the forward direction, the voltage is applied in the reverse direction. In the example shown in FIG. 9B, the voltage is applied alternately in forward and reverse directions.

In the example shown in FIG. 9C, after completion of the characteristic adjustment process, the electron emission device is driven by a pulse-width-modulated signal. More specifically, the anode voltage of the anode electrode 4 is maintained at Va, and a pulse voltage $Vg_2$ is applied between the cathode electrode 2 and the control electrode 3 while modulating the pulse width. This figure also shows the generated current Ie, generated in response to applying the voltage Vg2, which is close to the level Ie2.

In the case in which a pulse voltage is used as the driving voltage, it is desirable that the pulse width or the duty (pulse width/pulse cycle) be smaller than the pulse width or the duty of the pulse used to provide $V_{max}$ in the characteristic adjustment process. Note that the time spent for the characteristic adjustment process is determined in the range from a few milliseconds to a few minutes, depending on the type of the carbon layer 5.

As described above, to drive the electron emission device or the electron emission apparatus that has been subjected to the characteristic adjustment process, it is desirable to use a driving voltage less than the maximum voltage used in the characteristic adjustment process. Use of the driving voltage less than the voltage applied in the characteristic adjustment process makes it possible to maintain the electron emission characteristic (I-V characteristic) obtained as a result of the characteristic adjustment process. Furthermore, as in the example described above, it is desirable that the pulse width or the duty (pulse width/pulse cycle) used in driving be smaller than the pulse width or the duty used in the characteristic adjustment process.

Figure 10:
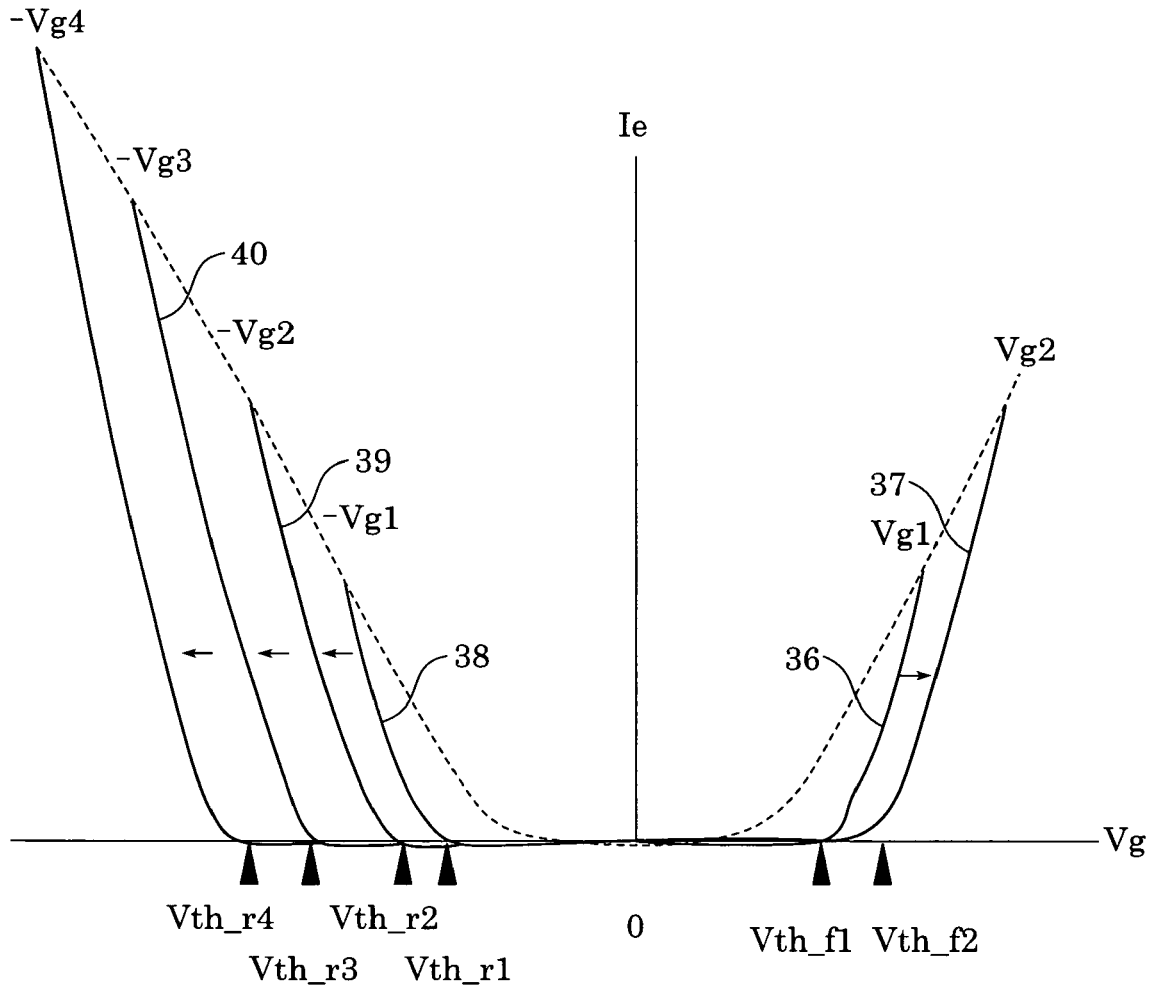
FIG. 10 is a graph showing a change in electrical characteristic of an electron emission device in a characteristic adjustment process according to the present invention.

FIG. 10 is a graph showing changes in the electrical characteristic of the electron emission device that occur in the characteristic adjustment process according to the present invention.

That is, FIG. 10 shows how the maximum voltage $V_{max}$ applied during the characteristic adjustment process changes the characteristic graph of the emission current Ie vs. the voltage Vg between the cathode electrode 2 and the control electrode 3 in the state in which an voltage Va is applied to the anode electrode.

Note that the "forward direction" refers to a direction in which the electric potential of the control electrode becomes positive with respect to the electric potential of the cathode electrode, and the "reverse direction" refers to a direction in which the electric potential of the cathode electrode becomes positive with respect to that of the control electrode. The potential of a cathode electrode is fixed and it shows the diagram of the electrical property as an opposite direction (reverse) that giving right potential to a control electrode gives the forward direction (forward) and negative potential.

Examples of changes in the forward electric characteristic are described below.

A solid line 36 represents an electrical characteristic of the electron emitting device obtained after the characteristic adjustment process is performed by increasing the voltage between the cathode electrode 2 and the control electrode 3 to $Vg_1$, then lowering this voltage to 0 (volts), and again increasing this voltage to $Vg_1$. A solid line 37 represents an electrical characteristic of the electron emission device obtained after the electron emission device is driven during the characteristic adjustment process by increasing the driving voltage to $Vg_2$, then lowering the driving voltage to 0 (volts), and again increasing the driving voltage to $Vg_2$. As a result of this characteristic adjustment process, the threshold voltage $V_{th_f1}$ needed to emit electrons changes to $V_{th_f2}$, and a corresponding change in Ie occurs. The dashed line shown on the right side of the Ie axis in FIG. 10 is a plot of the emission current obtained when the applied voltage is continuously increased from 0 (volts) to $Vg_2$ (volts) without being decreased at all during the characteristic adjustment process.

In FIG. 10, after the applied voltage is increased to $Vg_2$ and then decreased down to 0 (volts) (in the characteristic adjustment process), if the electron emission device is driven by applying a driving voltage while increasing the driving voltage up to $Vg_2$, then the emission current Ie varies along the solid line 37 in the range lower than $Vg_2$. When the driving voltage is changed thereafter within the range from 0 (volts) to $Vg_2$, no substantial change in the electron emission characteristic occurs.

The reason why the characteristic adjustment process stabilizes the electrical characteristic of the electron emission device and increases the threshold electric field is that although there are unstable electron emission sites capable of emitting electrons in low strength electric fields at the stage immediately after completion of production, such unstable electron emission sites are eliminated by the characteristic adjustment process, and thus the emission current is stabilized. Evidence for this is that positions of electron emission sites observed during the measurement of the electrical characteristic of the solid line 37 are different from those of the solid line 36, and the positions of electron emission sites do not change once the characteristic denoted by the solid line 37 has been obtained via the characteristic adjustment process.

As described above, the characteristic adjustment process also functions as a process of stabilizing the electrical characteristic of the electron emission film. That is, once the electrical characteristic of the electron emission film is adjusted such that a desired emission current can be obtained, the electrical characteristic is stabilized in what is called an adjusted state so that the device can be stably driven.

Now, a change in the electrical characteristic of the electron emission film in the reverse direction is discussed.

In the first embodiment, the second conductive film and the first conductive film are symmetrical in structure. Therefore, the initial electric characteristic in the reverse direction is similar to that in the forward direction, and a change that occurs in the electric characteristic in the reverse direction when a voltage is applied is very similar to that which occurs in the forward direction.

Note that in the reverse direction, unlike the forward direction in which electrons are emitted from the cathode electrode, electrons are emitted from the control electrode. This means that electron emission sites that contribute to the emission current Ie in the reverse direction are completely different from those in the forward direction.

Therefore, although electrons are emitted toward the anode electrode in both cases, the arrival points are different.

In FIG. 10, a solid line 38 represents an electrical characteristic obtained after the characteristic adjustment process is performed such that the voltage between the cathode electrode 2 and the control electrode 3 is changed to $-Vg_1$, then returned to 0 (volts), and again changed to $-Vg_1$. A solid line 39 represents an electrical characteristic obtained after the electron emission device is driven such that the driving voltage is first changed to $-Vg_2$, then returned to 0 (volts), and again changed to $-Vg_2$. As a result, the threshold voltage $V_{th}$ needed to emit electrons increased to $V_{th_r2}$ from $V_{th_r1}$, and corresponding change in Ie occurred. The dashed line shown on the left side of the Ie axis in FIG. 10 is a plot of the emission current obtained when the applied voltage is continuously changed from 0 (volts) to $-Vg_2$ (volts) without being returned to 0 (volts) during the characteristic adjustment process.

In FIG. 10, after the applied voltage is changed to $-Vg_2$ and then returned to 0 (volts) (in the characteristic adjustment process), if the electron emission device is driven by applying a driving voltage while changing the driving voltage to $-Vg_2$, then the emission current Ie varies along the solid line 39 in the range greater than $-Vg_2$.

If a greater reverse voltage is further applied, the reverse threshold voltage further increases. For example, applying a voltage of $-V_{g3}$ and then returning the applied voltage to 0 (volts), and again changing the applied voltage to $-V_{g3}$ causes the reverse threshold voltage to increase to $V_{th_r3}$. In this case, the reverse electrical characteristic is given by a solid line 40.

Thus, by applying the maximum voltage $V_{max}$, greater than that applied in the forward direction, to the electron emission device in the reverse direction before the electron emission device is brought into actual use, the threshold electric field $E_{th_r}$ needed to emit electrons from the second conductive film can be increased to a value greater than the threshold electric field $E_{th_f}$ needed to emit electrons from the first conductive film. As a result, the electrical characteristic of the electron emission device becomes asymmetric.

As described above, in the present invention, although the electron emission device is produced as a symmetric structure via a simple process, an asymmetric electrical characteristic can be obtained by performing the characteristic adjustment process. Note that the characteristic adjustment process according to the present invention is an electrical process that has no or little undesirable influence on the electron emission part, and thus a stable electrical characteristic can be obtained.

When the electron emission device is driven (electrons are emitted) in an actual operation after the characteristic adjustment process is performed in accordance with the present invention, it is desirable to drive the electron emission device such that the emission current does not exceed the maximum emission current in the characteristic adjustment process (effectively, such that the electric field strength does not exceed the maximum electric field strength used to emit electrons during the characteristic adjustment process, that is, such that the forward applied voltage does not exceed the maximum voltage applied in the forward direction to emit electrons in the characteristic adjustment process). By driving the electron emission device in the above-described manner, the I-V characteristic obtained via the characteristic adjustment process can be maintained. Note that "maintenance of the I-V characteristic obtained via the characteristic adjustment process" does not mean that no degradation can occur in the I-V characteristic of the electron emission device over a long term.

Now, the relationship between the maximum voltage applied in the reverse direction and the driving voltage is explained.

A change in the electrical characteristic that occurs when the reverse applied voltage is increased to $-Vg_4$, then returned to 0 (volts) and again increased to $-Vg_4$ is also shown in FIG. 10. As can be seen from FIG. 10, the reverse threshold voltage further increases to $V_{th_r4}$.

Figure 11A:
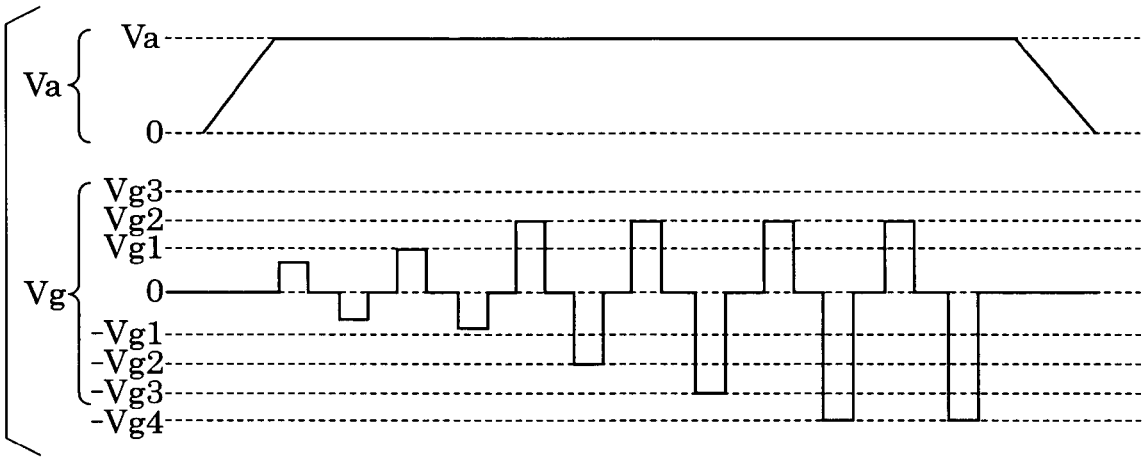
FIGS. 11A and 11B illustrate graphs showing examples of manners in which voltages are applied to an electron emission device in a characteristic adjustment step and in an actual operation, according to the present invention.
Figure 11B:
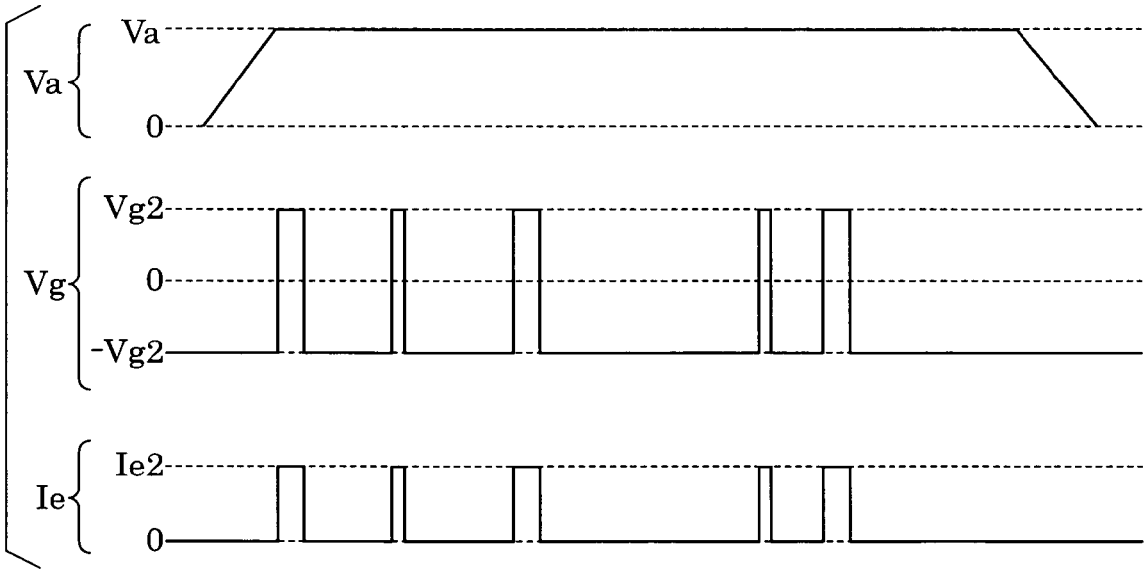

FIG. 11A shows an example of a manner in which the voltage is applied to the electron emission device in the characteristic adjustment process, and FIG. 11B shows an example of a manner in which the electron emission device is driven during an actual operation.

In FIG. 11A, a series of varying voltage pulses is applied between the cathode and the control electrode, while maintaining the anode voltage to anode electrode 4 at Va. The pulse voltage are alternately applied in the forward and reverse directions and increase in intensity from below $Vg_1$ to $Vg_2$ in the forward direction and from above $-Vg_1$ to $-Vg_4$ in the reverse direction to set the threshold voltage in the forward direction at $Vg_2$ and to set the threshold in the reverse direction at $Vg_1$. After the characteristic adjustment process shown in FIG. 11A, the threshold voltage $V_{th_r4}$ in the reverse direction is greater than the driving voltage $Vg_2$ in the forward direction. Therefore, when a voltage $-Vg_2$ is applied, that is, a voltage whose absolute value is equal to the driving voltage $Vg_2$ is applied in the reverse direction, substantially no emission current occurs.

This makes it possible to drive the electron emission device such that, as shown in FIG. 11B, a voltage whose absolute value is equal to the driving voltage is applied in the reverse direction during an off-period. This driving method needs a simpler driving circuit.

As a matter of course, the drive method shown in FIG. 9C may also be used. When the driving method shown in FIG. 9C is used, it is also desirable that the threshold electric field $E_{th_r}$ in the reverse direction be increased sufficiently by applying a great maximum electric field in the reverse direction in the characteristic adjustment process, because the large threshold electric field $E_{th_r}$ in the reverse direction allows the electron emission device to operate in a highly reliable fashion without being affected by spike noise or the like.

A method of applying the maximum voltage is described below.

In the characteristic adjustment process according to the present invention, electrons are emitted by applying a voltage to the extraction electrode (the control electrode and/or the anode electrode). During the characteristic adjustment process, a greater voltage is applied in the reverse direction than that applied in the forward direction, and thus a greater current is emitted from the control electrode in the characteristic adjustment process than the current emitted during the actual operation of the device. Therefore, the characteristic adjustment process must be performed so that the electron emission device is not destroyed by the emission current that occurs during the characteristic adjustment process.

To this end, it is important to prevent a discharge, caused by gas emission from the anode due to electron excitation, from occurring during the characteristic adjustment process. For this purpose, it is important to maintain sufficiently high vacuum.

In the characteristic adjustment process, the voltage may be applied to the electron emission device such that a pulse with a fixed pulse height is applied over a particular period or such that the pulse height gradually increases. The latter method is more preferable, although the former method is also employable. In the latter method, if necessary, a vacuum level and/or other parameters may be monitored during the characteristic adjustment process, and the increasing of the voltage may be controlled in accordance with the monitored vacuum level.

In other words, it is not desirable to apply too high a voltage in the reverse direction. That is, as described above, the voltage applied in the reverse direction should be determined so that a proper on/off ratio needed during an actual operation can be obtained.

In the characteristic adjustment process, it is desirable to apply voltages to both the anode electrode and the control electrode, although it is not necessarily needed to apply a voltage to the anode electrode. This is desirable in particular when the anode electrode has a great influence on the electric field.

If no voltage is applied to the anode electrode (a voltage is applied only between the cathode electrode and the control electrode), the distribution of the electric field imposed on emitted electrons is different from that imposed on emitted electrons in actual operation. Some emitted electrons move toward an opposing electrode, when no voltage is applied to the anode electrode.

When a voltage is applied in the reverse direction, electrons emitted from the control electrode move toward the cathode electrode. When electrons collide with the cathode electrode, some electrons are absorbed by the cathode electrode, and the cathode electrode is heated. The collision of electrons and heating can have a negative influence on the electron emission film on the cathode electrode, and degradation in electron emission characteristic can occur.

Therefore it is desirable that the electric field distribution in the characteristic adjustment process be similar to that in actual operation.

When the electron emission apparatus including the electron emission device has a three-terminal (triode) structure (including three electrodes, that is, the anode electrode, the cathode electrode, and the gate electrode), it is desirable that in the characteristic adjustment process, the three electrodes be placed such that the relative positions thereof are similar to those in actual operation. This is also true for an electron emission apparatus having a four-terminal structure.

Now, examples of the applications of the electron emission device according to the present invention are described below. Electron emission apparatuses such as an electron source and an image display device can be produced by arranging a plurality of electron emission devices according to the present invention on a substrate.

Electron emission devices may be arranged in various manners. For example, a plurality of electron emission devices are arranged in both X and Y directions in the form of a matrix and electrodes are connected such that cathode electrodes 2 (or control electrodes 3) of respective electron emission devices arranged in the same row are all connected to a wiring extending in the X direction, and control electrodes 3 (or cathode electrodes 2) of respective electron emission devices arranged in the same column are all connected to a wiring extending in the Y direction. This arrangement is called a matrix arrangement.

Figure 12:
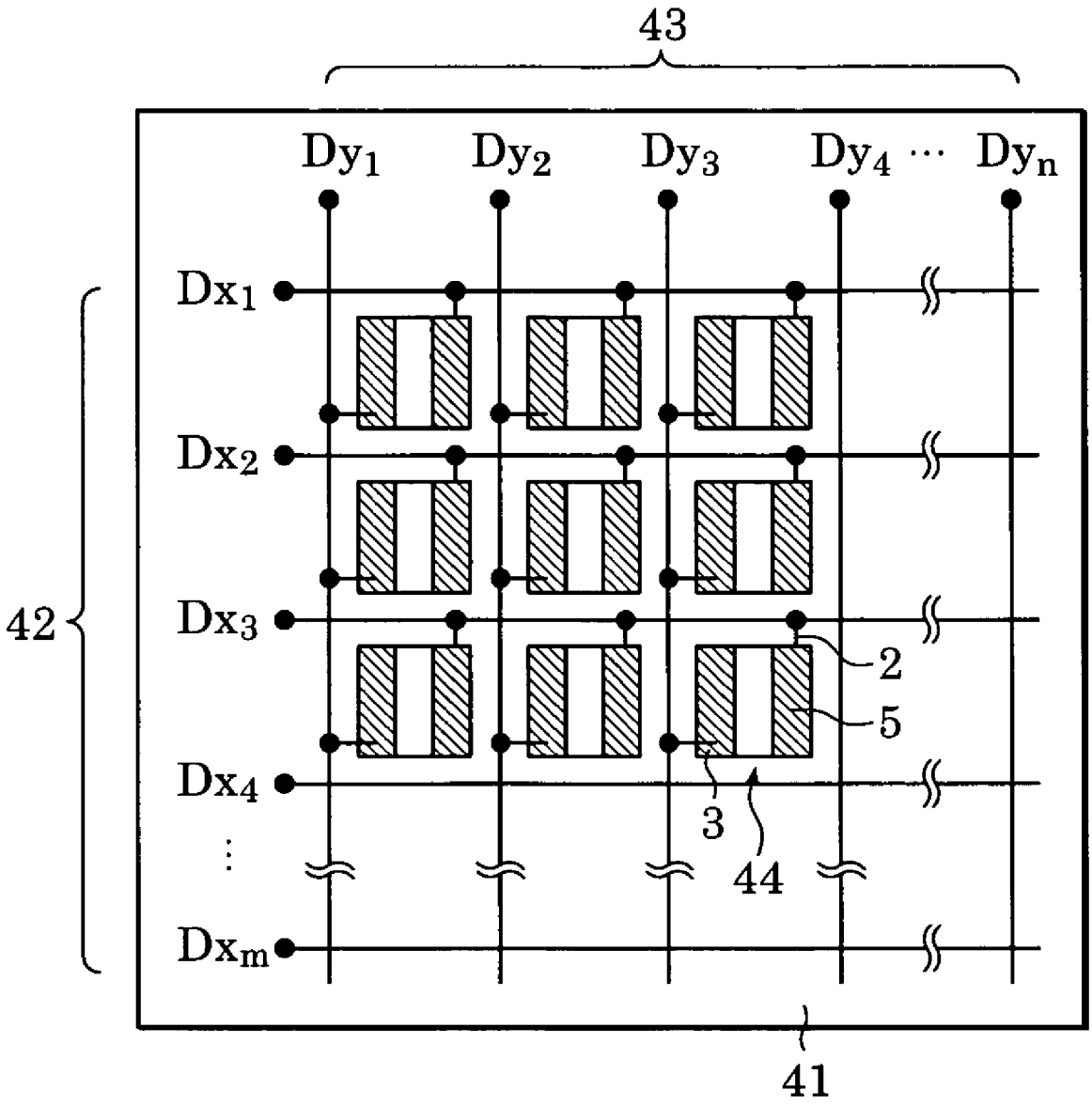
FIG. 12 is a plan view showing an example of an electron source using electron emission devices according to an embodiment of the present invention.

An example of an electron source produced by arranging a plurality of electron emission devices according to the present invention in the form of a matrix is described below with reference to FIG. 12. In FIG. 12, reference numeral 41 denotes an electron source substrate, reference numeral 42 denotes rows of wirings extending in the X direction, reference numeral 43 denotes columns of wirings extending in the Y direction, and reference numeral 44 denotes an electron emission device according to the present invention. Each square of the matrix, which includes a cathode electrode 2, a control electrode 3, a film 5 attached to each electrode, comprises a different electron emission device 44. The cathode electrode 2 of each electron emission device 44 is connected to one row of the wiring 42, and the control electrode 3 of each electron emission device 44 is connected to one column of wiring 43.

m wirings 42 in the X direction including wirings $Dx_1$, $Dx_2$, $Dx_3$, $Dx_4$, . . . , $Dx_m$ are formed of a metal material by means of vacuum evaporation, sputtering, or printing. The specific material, thickness, and width of wirings are properly determined as known to those skilled in the art. n wirings 43 in the Y direction including wirings $Dy_1$, $Dy_2$, $Dy_3$, $Dy_4$, . . . , $Dy_n$ are formed in a similar manner to the wirings 42 in the X direction. The m wirings 42 in the X direction are electrically isolated from the n wirings 43 in the Y direction by an interlayer insulating layer (not shown). Note that n and m are arbitrary integers.

The interlayer insulating layer (not shown) is formed of, for example, $SiO_2$ by means of vacuum evaporation, sputtering, or printing. For example, after the wirings 42 in the X direction are formed on the substrate 41, the interlayer insulating layer is formed over the entire surface or over an area with a particular shape of the surface of the substrate 41. The material, the thickness, and the production method of the interlayer insulating layer are determined such that no electrical breakdown occurs at any intersection between the wirings 42 in the X direction and the wirings 43 in the Y direction. An end portion of each wiring 42 in the X direction and an end portion of each wiring 43 in the Y direction extend such that they serve as external terminals.

The cathode electrodes 2 of the respective electron emission devices 44 are electrically connected in the above-described manner via the m wirings 42 in the X direction and the control electrodes 3 of respective electron emission devices 44 are electrically connected in the above-described manner via the n wiring 43 in the Y direction.

In a case in which the wirings are formed of the same material as the material of the cathode electrode 2 and the control electrodes 3, the wirings 42 and the wirings 43 can be regarded as cathode electrode wirings and control electrode wirings, respectively.

The wirings 42 in the X direction are connected to scan signal applying means (not shown) for applying a scan signal to select a row in which electron emission devices 44 are arranged in the X direction. The wirings 43 in the Y direction are connected to modulation signal generation means (not shown) for modulating electron emission devices 44 arranged in respective columns extending in the Y direction in accordance with an input signal. A driving voltage applied to each electron emission device 44 is given as a difference between the voltage of a scan signal applied to the device and the voltage of a modulation signal applied to the same device. Although in this specific example, the scan signal is applied to the cathode electrode 2, and the modulation signal is applied to the control electrode 3, the modulation signal may be applied to the cathode electrode 2 and the scan signal may be applied to the control electrode 3.

Figure 13:
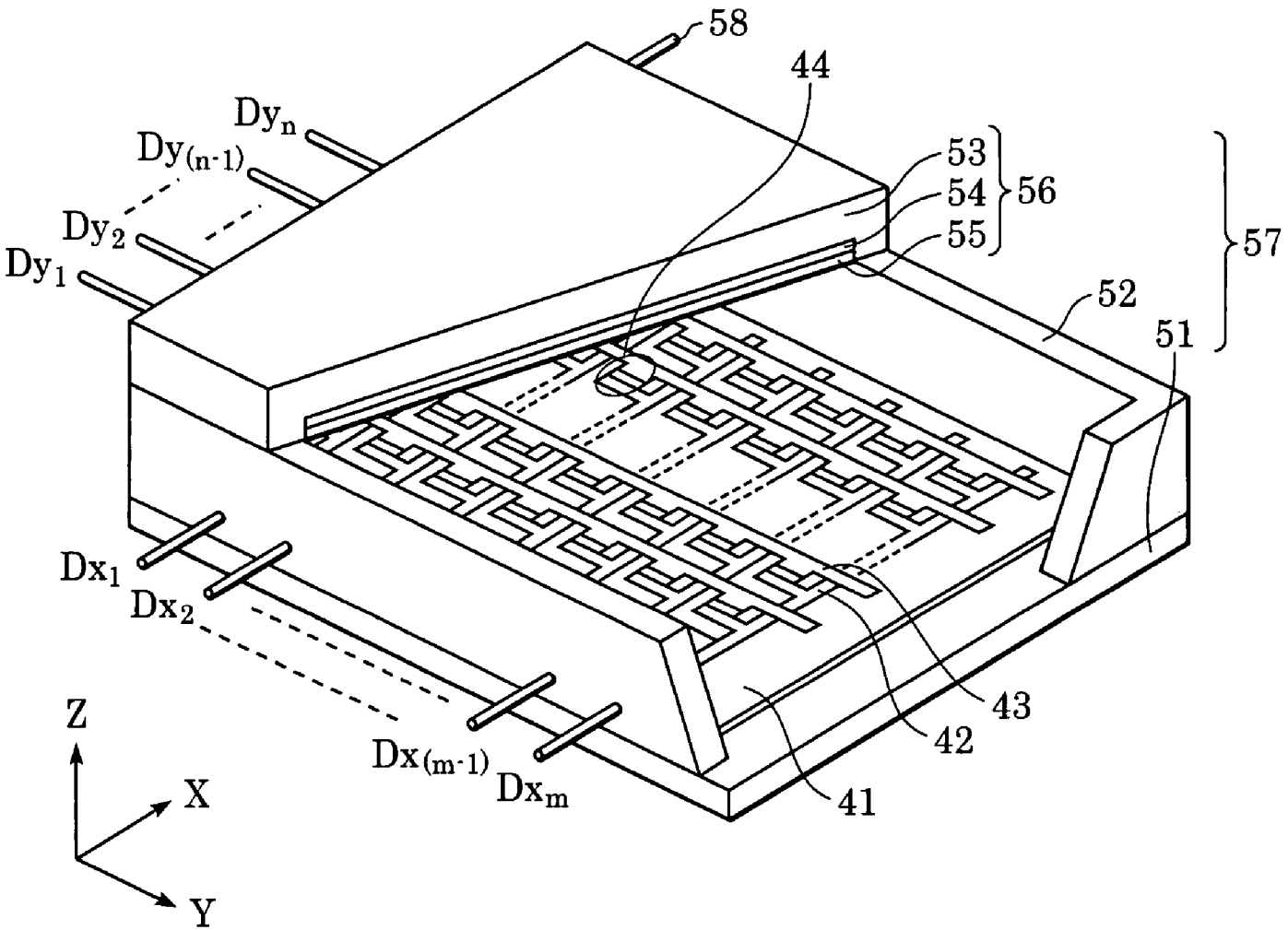
FIG. 13 is a perspective view showing an image display device using an electron emission device according to an embodiment of the present invention.

In the electron emission source constructed in the above-described manner, individual electron emission devices 44 can be selected and driven independently via the simple matrix wirings. An image display device can be produced using such an electron emission source in which electron emission devices are arranged in the form of a simple matrix, as described below with reference to FIG. 13. FIG. 13 is a schematic diagram showing an example of a display panel of an image display device according to the present invention.

In FIG. 13, reference numeral 41 denotes an electron source substrate on which a plurality of electron emission devices are disposed, reference numeral 51 denotes a rear plate on which the electron source substrate 41 is fixed, and reference numeral 56 denotes a face plate composed of a glass substrate, a light-emitting film (such as a fluorescent film) 54 serving as an image forming element and a metal back 55 wherein the light-emitting film 54 and the metal back 55 are disposed on the inner surface of the glass substrate 53. When an image is displayed on this image display device, the light-emitting 54 serves as a screen. Reference numeral 52 denotes a support frame to which the rear plate 51 and the face plate 56 are connected via frit glass or the like. The parts described above are combined together and sealed by performing a baking operation in an atmospheric ambient or nitrogen ambient at a temperature of 400 to 500° C., such that the face plate 56, the support frame 52, and the rear plate 51 form an envelope (display panel) 57.

The envelope 57 is formed of the face plate 56, the support frame 52, and the rear plate 51.

The rear plate 51 is disposed mainly in order to reinforce the mechanical strength of the substrate 41. When the substrate 41 has sufficiently large mechanical strength, the rear plate 51 is unnecessary. In this case, the support frame 52 is directly placed on the substrate 41 and the face plate 56 is placed on the support frame 52, and they are bonded together so as to form the envelope 57. A supporting part called a spacer may be disposed between the face plate 56 and the rear plate 51 such that the envelope 57 has a mechanical strength sufficiently large to withstand atmospheric pressure.

Thereafter, the inside of the envelope 57 is evacuated of air.

More specifically, the inside of the envelope 57 is evacuated using a vacuum pump via an evacuation pipe (not shown) while heating the envelope (display panel) 57. After the pressure in the inside of the envelope 57 has become sufficiently low, the evacuation pipe is sealed. After the envelope 57 is sealed, gettering may be performed to achieve a lower internal pressure. Gettering may be performed by means of evaporation of a gettering material such as Ba, or may be performed by means of a non-evaporation gettering technique. Although in the example described above, evacuation is performed after the parts are assembled into the form of the envelope, the evacuation is not necessary if the assembling is performed in a vacuum.

In this image display device produced using the matrix electron source, an arbitrary electron emission device can be selected and driven by applying voltages to external terminals $Dx_1$ to $Dx_m$ and $Dy_1$ to $Dy_n$ to emit electrons from the selected electron emission device. If a high voltage Va is applied to the metal back 55 or a transparent electrode (not shown) via a high-voltage terminal 58, emitted electrons are accelerated. The accelerated electrons collide with the fluorescent screen 54, and luminescence occurs. As a result, an image is formed.

An information display/playback apparatus can be produced using the display panel 57 according to the present invention, described above with reference to FIG. 13.

The information display/playback apparatus includes a receiving unit for receiving broadcast signals such as television signals, a tuner for selecting one of the received signals, and the display panel on which to display or play back at least one of image information, text information, and audio information included in the selected signal. A specific example of such an information display/playback apparatus is a television receiver. In a case in which an encoded broadcasting signal is received, the information display/playback apparatus needs to include a decoder. Note that an audio signal is output to audio reproduction means such as a speaker disposed separately such that a sound/voice is generated in accordance with the audio signal synchronously with the image information or text information displayed on the display panel.

A technique of displaying or playing back image information or text information on the screen of the display panel is described in further detail below. First, image signals corresponding to respective pixels of the display panel are produced from the received image information or text information. The produced image signals are input to a driver circuit of the display panel 57. Based on the input image signals, the driver circuit controls the voltages applied to the respective electron emission devices in the display panel so that an image is displayed on the display panel.

Figure 19:
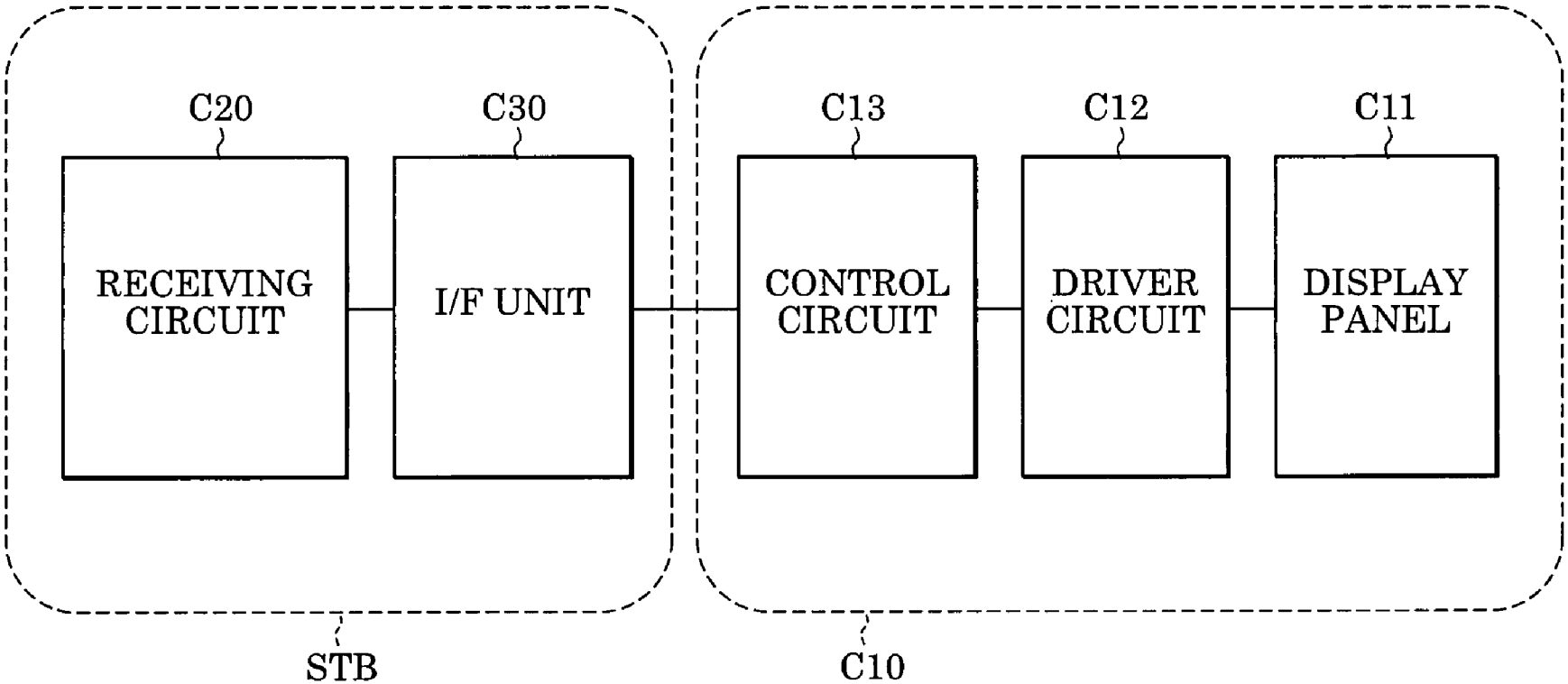
FIG. 19 is a schematic block diagram showing an example of an information display/playback apparatus using an image display device according to the present invention.

FIG. 19 is a block diagram of a television receiver according to the present invention. The television receiver comprises a unit to receive and process a broadcast signal, which in this embodiment is a set top box STB, and a display device C10 to display an image based on the broadcast signal. The set top box STB comprises a receiving circuit C20 including a tuner and decoder to receive a terrestrial or satellite broadcast television signal or data broadcast signal. The received signal is demodulated/decoded, and the resultant image data is output to an I/F (interface) unit C30 of the STB. The I/F unit C30 converts the received image data into a format adapted for use by the display device C10 and outputs the resultant image data to a control circuit C13 of the display device C10, which also includes the display panel 57, which is also denoted by C11 in this embodiment, and a driver circuit 12. The control circuit C13 performs image processing such as a correction process on the input image data so as to convert the image data to data optimum for the display panel C11, and the control circuit C13 outputs the resultant image data to the driver circuit C12 together with various control signals. In accordance with the received image data, the driver circuit C12 outputs driving signals over the respective wirings (Dx1 to Dxm and Dy1 to Dyn shown in FIG. 12) of the display panel C11 such that an image is displayed on the display panel C11. The receiving circuit C20 and the I/F unit C30 may be disposed in another case separately from the image display device C10 as in the case of the set to box STB shown in FIG. 19 or may be disposed in a single case together with the image display device.

The I/F unit C30 may be formed so as to have the capability of connecting to an image recording apparatus or an image output apparatus such as a printer, a digital video camera, a digital camera, a hard disk drive (HDD), or a digital videodisc (DVD). This makes it possible for the information display/playback apparatus (television receive) to display an image recorded on an image recording apparatus on the display panel 57. It also becomes possible to modify an image displayed on the display panel 57 as required, and output the resultant image to the image output apparatus.

Note that the information display/playback apparatus described above is one of many possible examples, and the various modifications are possible. By connecting the information display/playback apparatus according to the present invention to a system such as a video conference system or a computer system, it is possible to realize an information display/playback system in various manners.

Also in the image display device according to the present invention, the characteristic adjustment process described above may be performed before the image display device is brought into actual operation. This makes it possible for the image display device to operate in a stable and highly reliable fashion. The characteristic adjustment process may be performed after the electron source substrate is produced by forming an electric field between the electron source substrate and an anode substrate prepared for dedicated use in the characteristic adjustment process, or the characteristic adjustment process may be performed after the display panel (envelope) 57 is produced. Preferably, the characteristic adjustment process is performed after the envelope is sealed.

In the embodiment described above, the characteristic adjustment process is performed in a state in which the respective electrodes are placed in relative positions similar to those in the electron emission apparatus. However, in the present invention, the positions of the respective electrodes are not limited to such positions. That is, what is necessary is to apply, during the characteristic adjustment process, a higher electric field to the cathode electrode (control electrode) than to the cathode electrode (control electrode) when the electron emission apparatus is in actual operation, and the necessary electric field to be applied can be determined from the relative positions of the respective electrodes of the electron emission apparatus. For example, in the case in which the characteristic adjustment process is performed before the parts are assembled into the form of the display panel, the anode electrode may be placed at a location spaced apart from the cathode electrode by a distance greater than the distance between the anode electrode and the cathode electrode in the state that all parts are assembled into the display panel, and the voltage applied to the anode electrode may be adjusted such that the electric field becomes equal to $E_{max}$.

The characteristic adjustment process may also be used to reduce the variation in I-V characteristics among electron emission devices, which can occur in the production process of the electron emission devices.

That is, the characteristic adjustment process is performed to change the characteristics of the respective electron emission devices so that all electron emission devices have substantially equal Ie (electron emission current) and/or If (current flowing between the cathode electrode and the gate electrode). By adjusting the characteristics of the respective electron emission devices in the above-described manner, it becomes possible to improve uniformity of an image displayed on the display device.

An example of driving the simple-matrix electron source is described below with reference to FIGS. 14A and 14B. In these figures, scan signals are applied along wirings or scanning lines denoted as Dox extending in rows in the X direction, while the modulation signals are applied along the wiring or signal lines denoted as Doy extending in columns in the Y direction. Two scanning lines are shown in these figures, one of which applies a voltage Vs to two electron emission devices and the other of which applies a voltage Vns to two electron emission devices. Two signal lines are shown in these figures, one of which applies a voltage of Vm to two electron emission devices and the other of which applies a voltage a voltage of Vnm to two electron emission devices.

Herein, it is assumed that scanning is performed line-sequentially and a pulse-width-modulated voltage is applied. For the purpose of simplicity, two scanning lines one of which is in the on-state and the other in the off state, and two signal lines one of which is in the on-state and the other in the off state are shown, and four possible states of electron emission devices are shown.

Figure 14A:
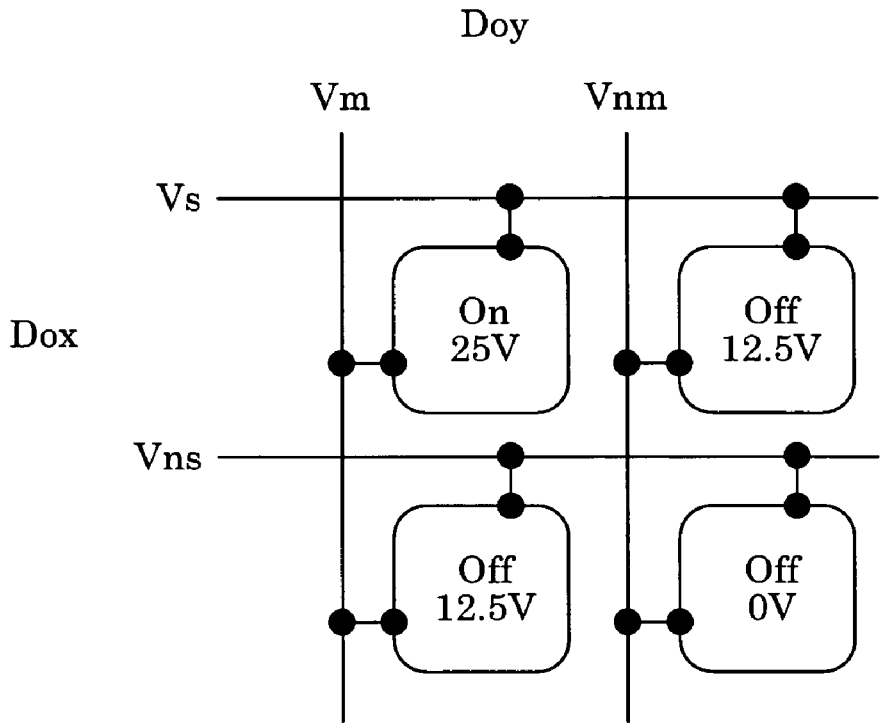
FIGS. 14A and 14B illustrate schematic views of an example of the manner in which an image display device is driven according to the present invention.

In FIG. 14A, a voltage of Vs is applied to a scanning line in the on-state, while a voltage of Vns is applied to a scanning line in the off-state. On the other hand, a voltage of Vm is applied to a signal line in the on-state, while a voltage of Vnm is applied to a signal line in the off-state.

When both the scanning line and the signal line are in the on-state, the corresponding electron emission device is selected (turned on) and a voltage equal to Vm−Vs is applied to the selected electron emission device. That is, the voltage equal to Vm−Vs serves as the driving voltage. When both the scanning line and the signal line are in the off-state, the corresponding electron emission device is not selected (turned off), and a voltage equal to Vnm−Vns is applied to the non-selected electron emission device. When either the scanning line or the signal line is in the off-state, a voltage equal to Vm−Vns or Vnm−Vs is applied to the corresponding electron emission device. Any electron emission device in this state is also not selected (turned off). This state in which only one of the scanning and the signal lines is in the off-state is referred to as a semi-selected state to distinguish the state from the non-selected state.

Figure 14B:
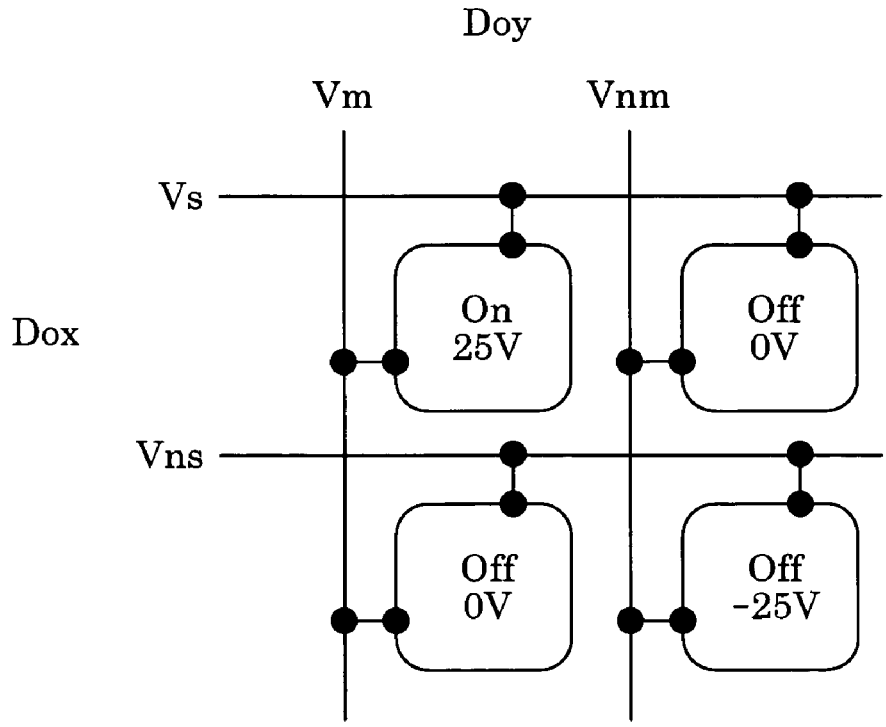

FIGS. 14A and 14B show an example of a manner in which electron emission devices are driven.

In the example shown in FIG. 14A, the semi-selection voltage of 12.5 V is equal to about one-half of the forward driving voltage of 25 V. In this driving method, during actual operation, no reverse electric field is applied to any electron emission device when the electron emission devices are in the non-selected state or in the semi-selected state, and thus the driving method can also be applied to electron emission devices produced without using the production process according to the present invention. However, in order to maintain semi-selected electron emission devices in the off-state, the forward threshold voltage $V_{th_f}$ must be greater than the semi-selection voltage.

In the example shown in FIG. 14B, no voltage (0 (volts)) is applied to semi-selected electron emission devices (i.e., the electron emission devices receiving voltages Vnm and Vs, and receiving voltages Vm and Vns), and thus semi-selected electron devices are easily turned off. However, when electron emission devices are non-selected (i.e., the electron emission device receiving voltages Vns and Vnm), a voltage equal to the driving voltage is applied in the reverse direction. Therefore, this driving method cannot be used for electron emission devices unless the electron emission devices are produced according to the present invention. To use this driving method, the reverse threshold voltage $V_{th_r}$ must be greater than the driving voltage so that electron emission devices are turned off when they are non-selected.

This can be achieved by performing the characteristic adjustment process to increase the reverse threshold voltage, as described earlier with reference to FIG. 11.

The on/off ratio in driving of the electron source, and the halftone representation on the image display device are described below.

The halftone representation is achieved by modulating the voltage amplitude or the pulse width of pulses applied to the electron source or by a combination of these methods. In any case, the halftone representation is achieved by changing the total amount of charge given by the pulse.

A simple definition of the on/off ratio is the ratio of the maximum amount of charge (i.e., the maximum current flowing from the cathode electrode) produced by a pulse applied to an electron emission device (in the on-state) to the amount of charge (i.e., the current flowing from the cathode electrode) produced by a pulse applied to the electron emission device in the semi-selected or non-selected state (off-state).

In the case of an image display device, the on/off ratio is the ratio (contrast) of the intensity of luminescence in a state in which the image display device is driven in the on state to the intensity of luminescence in a state in which the image display device is driven in the off state. The greater the on/off ratio, the greater the contrast of the image display device.

As the contrast becomes greater, the full range of intensity can be divided into a greater number of intensity levels, and thus higher-quality halftone representation is possible.

Preferably, the contrast of image display devices is greater than 100:1, and more preferably greater than 1000:1. To achieve such contrast, the on/off ratio of the electron source is preferably greater than 1000:1 and more preferably greater than 10000:1.

Figure 15A:
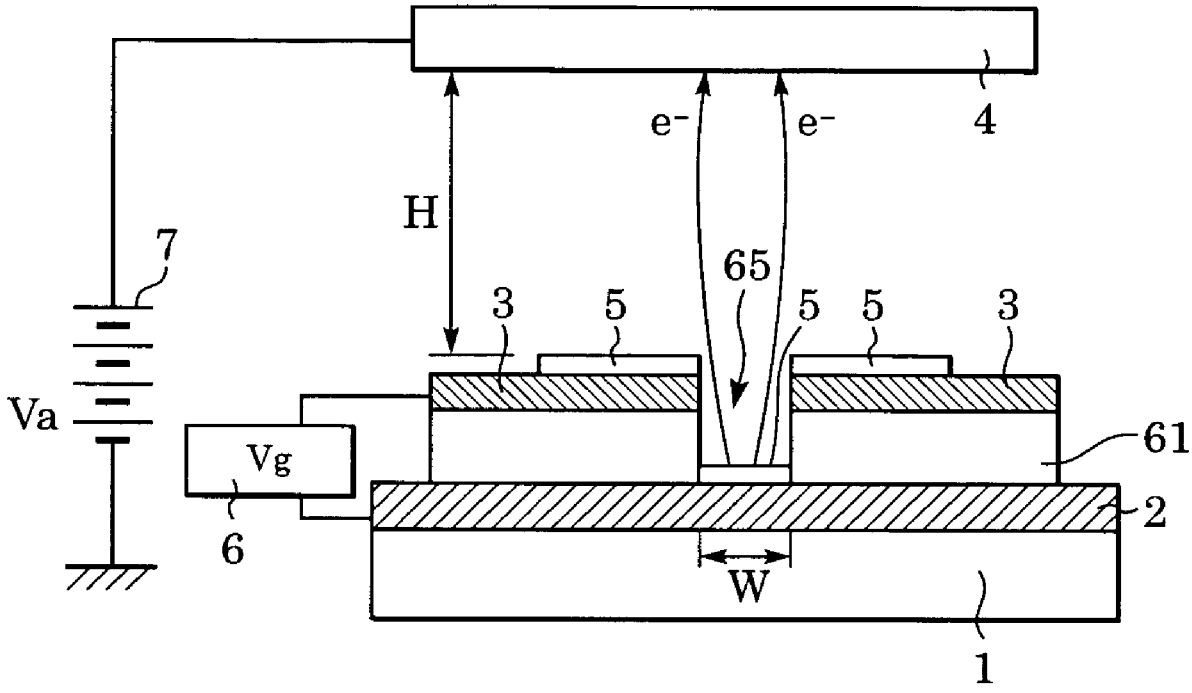
FIG. 15A is a cross-sectional view and FIG. 15B is a plan view of an electron emission device according to an embodiment of the present invention.
Figure 15B:
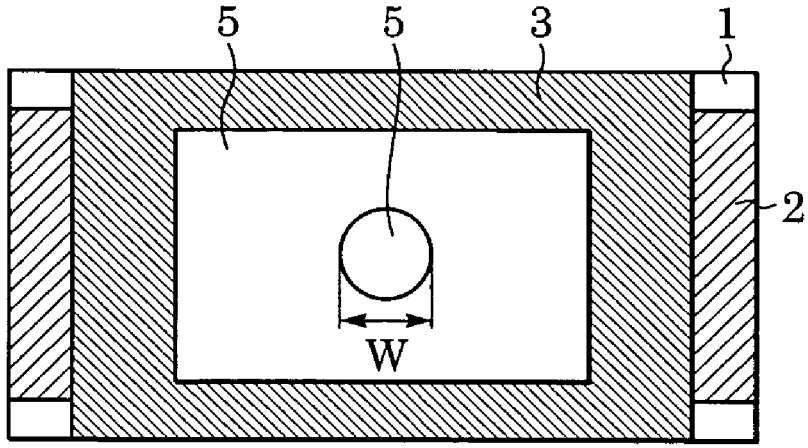

FIGS. 15A and 15B are schematic diagrams showing an embodiment (second embodiment) of an electron emission device according to the present invention.

FIG. 15A is a cross-sectional view of the electron emission device being in driven, FIG. 15B is a plan view of the electron emission device. In these figures, reference numeral 1 denotes a substrate, reference numeral 2 denotes a cathode electrode, reference numeral 3 denotes a control electrode, reference numeral 4 denotes an anode electrode, reference numeral 5 denotes an electron emission film, reference numeral 6 denotes a driving power supply, reference numeral 7 denotes an anode power supply, reference numeral 61 denotes an insulating layer, and reference numeral 65 denotes an opening. In this electron emission device, when a driving voltage Vg (volts) is applied between the cathode electrode 2 and the control electrode 3 and a voltage Va (volts) higher than Vg is applied to the anode electrode 4, electrons are emitted from the first conductive film (the electron emission film 5), and an electron emission current Ie [A] flows.

In this second embodiment of the electron emission device according to the present invention, the cathode electrode and the control electrode (gate electrode) are formed so as to be asymmetric to each other. The material of the electron emission film 5 may be intentionally or unintentionally formed on the control electrode (gate electrode).

A production process according to the second embodiment of the present invention also includes a process of producing the electron emission device and a process of adjusting the electron emission characteristic thereof, as in the first embodiment.

In the second embodiment, the asymmetry is expanded in the characteristic adjustment process.

Referring to FIG. 16A through 16F, an example of the process of producing the electron emission device preferably having the structure shown in FIG. 15 is described below.

Step 1

Figure 16A:
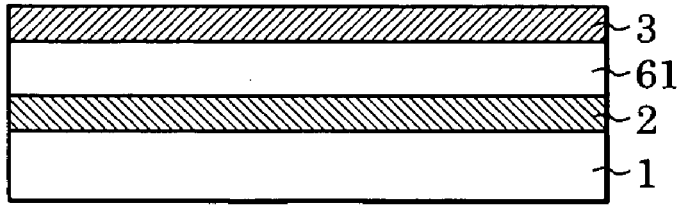
FIGS. 16A to 16F illustrate schematic views of an example of a process of producing an electron emission device according to the present invention.

First, a substrate 1 made of quartz glass, glass including a low concentration of impurities such as Na, soda-lime glass, a multilayer substrate whose top layer is a $SiO_2$ layer, or a insulating ceramic substrate is prepared. After the surface of the substrate 1 is well cleaned, a cathode electrode 2, an insulating layer 61, and a control electrode 3 are formed one on another on the substrate 1 (FIG. 16A).

The cathode electrode 2 and the control electrode 3 may be formed using a common vacuum film formation technique such as vapor deposition or sputtering. The material of the cathode electrode 2 and the control electrode 3 may be selected from metal materials such as Be, Mg, Ti and Zr, Hf, V, Nb, Ta, Mo, W, Al, Cu, Ni, Cr, Au, Pt, and Pd or an alloy thereof. The thickness of the cathode electrode 2 and that of the control electrode 3 are set preferably in the range of a few ten nm to a few mm, and more preferably in the range from a few hundred nm to a few μm.

The insulating layer 61 is formed using a common vacuum film formation technique such as sputtering method, a CVD method, or a vacuum evaporation method. The threshold electric field, which determines the electric characteristic of the electronic emission device, depends on the distance between the cathode electrode 2 and the gate electrode 3. The distance between the cathode electrode 2 and the gate electrode 3 is determined by the thickness of the insulating film 61. Thus, the thickness of the insulating film 61 is determined such that a necessary electric characteristic is obtained. Usually, the thickness of the insulating film 61 is selected in the range of a few nm to a few hundred μn, and more preferably in the range of a few hundred nm to a few μm. As a material of the insulating film 61, preferably, a material having a high dielectric strength that allows the insulating layer 61 to withstand a high electric field is used. Specific examples include $SiO_2$, SiN, $Al_2O_3$, and CaF.

Step 2

Figure 16B:
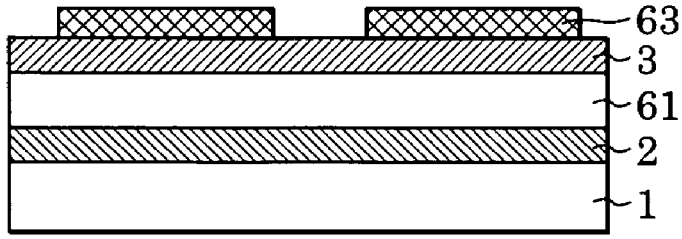

A photoresist pattern 63 to be used as a mask in an etching process for forming an opening 65 is formed by means of photolithography (FIG. 16B).

Step 3

Figure 16C:
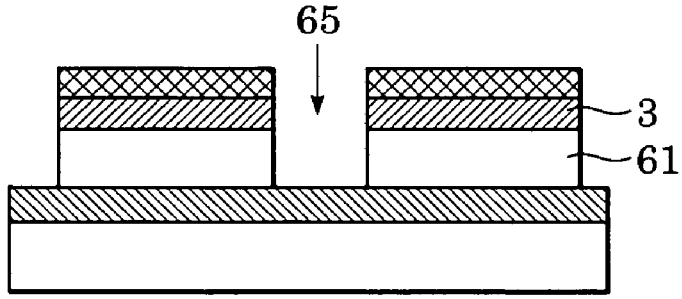
Figure 16D:
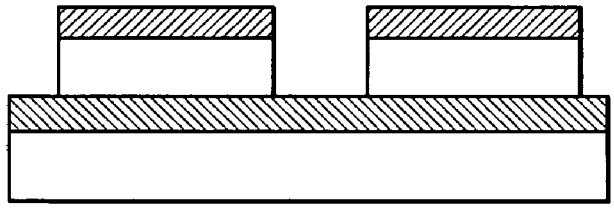

Subsequently, etching is performed to form the opening 65 (FIG. 16C). It is desirable that the control electrode 3 and the insulating film 61 be etched such that a flat etched surface is obtained. A proper etching method, such as dry etching or wet etching, may be used depending on the materials of the control electrode 3 and the insulating film 61.

Step 4

The mask 63 is the removed. As a result, a structure shown in FIG. 16D (FIG. 15) is obtained.

The opening width W (shown in FIG. 15) is determined depending on materials of the electron emission device, the resistance of the materials, and the shape of the electron emission beam to be emitted. In general, W is preferably set within the range from a few hundreds nm to 100 μm.

Step 5

Subsequently, a carbon layer 5 is deposited.

Figure 16E:
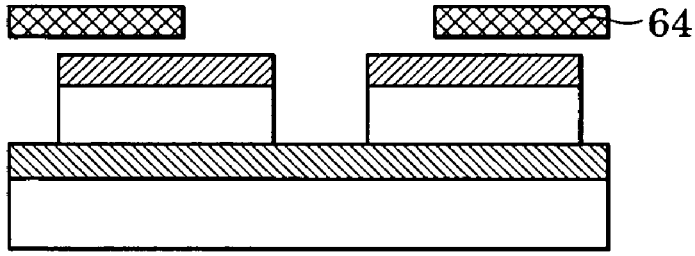
Figure 16F:
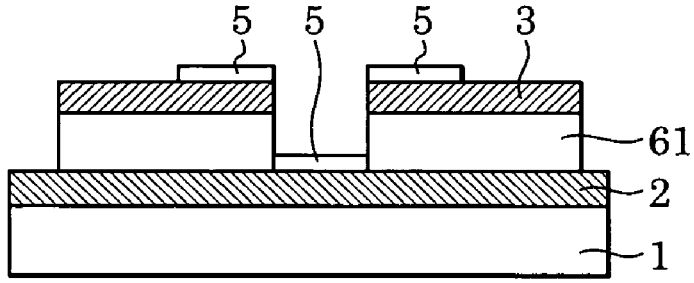

More specifically, as shown in FIG. 16E, the carbon layer 5 is deposited via a mask 64 having an opening at a location corresponding to the location at which to form the carbon layer 5 as shown in FIG. 16F.

As in the first embodiment, it is desirable that the carbon layer 5 be formed of a proper material in a proper structure that allows electron emission in low strength electric fields.

As required, post processing may be performed to enhance the capability of emitting electrons. Examples include annealing and plasma processing. In the case in which a surface terminating layer (dipole layer) is formed such as that shown in FIG. 6, it is preferable that the post processing be performed at this stage.

Step 6

Subsequently, the characteristic adjustment process, which characterizes the present invention, is performed.

Figure 17:
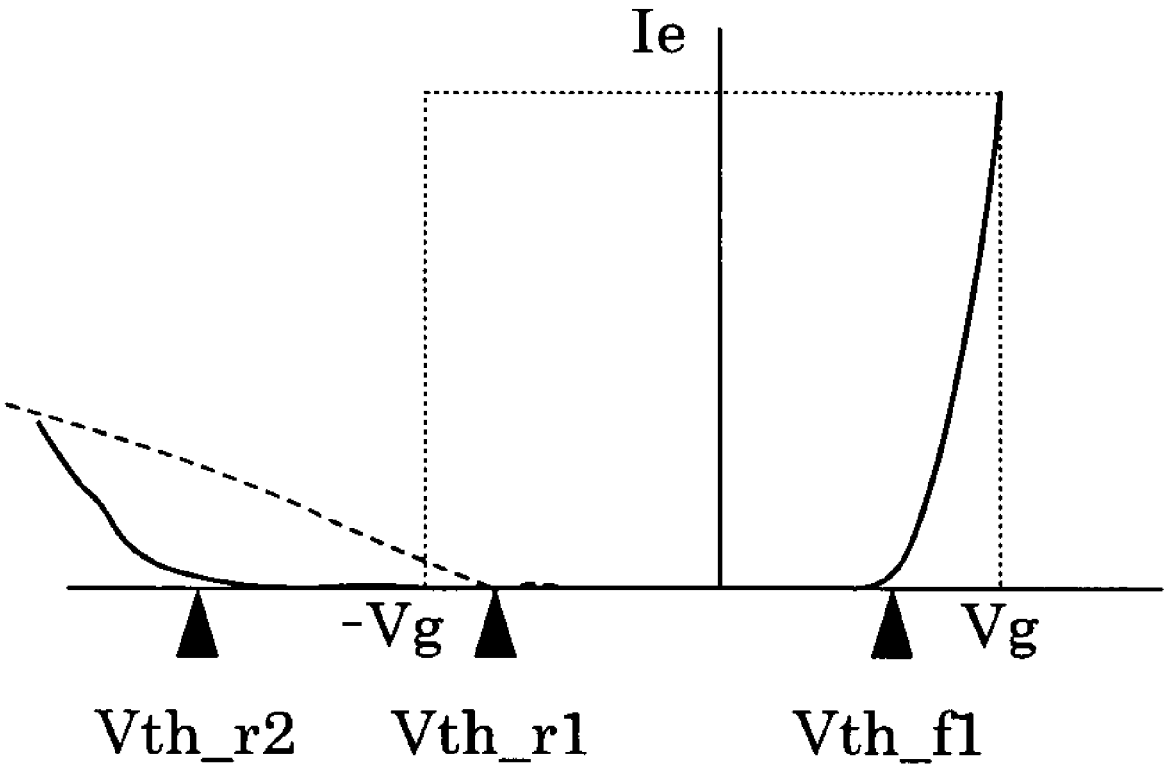
FIG. 17 is a graph showing a change in electrical characteristic of an electron emission device in a characteristic adjustment process according to the present invention.

In this step, as in the characteristic adjustment process according to the first embodiment, a reverse electric field is applied to change the electric characteristic as shown in FIG. 17.

In this second embodiment, because of the asymmetric structure, the reverse threshold electric field (Vth_r1) is greater than the forward threshold electric field (Vth_f1) in the initial state (the dotted line starting at Vth_r1 in FIG. 17 representing the dependence of the current Ie on the applied voltage when the reverse threshold electric field is set as Vth_r1). However, the reverse threshold electric field in the initial state (Vth_r1) is not large enough relative to the forward threshold electric field (Vth_f1). If the electron emission device is driven as shown in FIG. 11B, the insufficient initial magnitude of the reverse threshold electric field causes electrons to be emitted in the non-selected state (off-state).

Thus, in this characteristic adjustment process, the reverse threshold electric field is increased to a value greater than the absolute value of the driving voltage as represented by Vth_r2 in FIG. 17 such that the driving method shown in FIG. 11B can be used. This is accomplished by applying a large reverse voltage to the electron emission device than was applied to obtain Vth_r1 in the characteristic adjustment process. The solid line starting at Vth_r2 in FIG. 17 represents the dependence of the current Ie on the applied voltage when the reverse threshold electric filed is set as Vth_r2. It should be noted that the various forward and reverse threshold electric fields in this embodiment are set as was done in the earlier embodiments by increasing the voltage applied to the device to a predetermined voltage, returning the voltage to 0, and again increasing the voltage to that predetermined voltage.

In the electron emission device according to the present embodiment of the invention, an emission current Ie in the reverse direction can occur because of electron emission from an electron emission material deposited on the gate electrode. But once the characteristic adjustment process is performed, such electron emission from the electron emission material on the gate electrode in the normal operation is suppressed.

In this second embodiment of the present invention, as described above, although the electron emission film is formed at the final stage of the production process, the electron emission film is not brought into contact with any solution such as a resist removal. Even if the material of the electron emission film is deposited in an area close to the gate electrode, a good electron emission characteristic is obtained.

Also in the electron emission device according to the second embodiment, the forward characteristic adjustment process may be performed in a similar manner as described in the first embodiment to control the electron emission characteristic of the electron emission device. This allows a reduction in variation in I-V characteristic among electron emission devices in an electron source or an image display device. The electron emission devices used in the electron source or the image display device according to the first embodiment described earlier may be simply replaced with electron emission devices according to the second embodiment.

EXAMPLES

The invention is described in further detail below with reference to examples.

Example 1

Specific examples based on the production method shown in FIGS. 8 and 9 are described.

An electron emission device including a carbon layer 5 with a dipole layer 11 shown in FIG. 6 was produced.

Step 1

First, a substrate 1 of quartz glass was prepared. After the substrate 1 was cleaned well, a conductive film 31 to be further formed into a cathode electrode 2 and the gate electrode 3 was formed by sputtering TiN on the substrate 1 to a thickness of 100 nm (FIG. 8A).

Step 2

A carbon layer 5 with a thickness of 4 nm was then formed by means of sputtering using graphite as a target in an ambient of argon. The resistivity of the obtained carbon layer 5 was $1\times10^{11}$ Ω·cm (FIG. 8B).

Step 3

A resist mask 33 with a thickness of 1 μm was produced by means of a photolithographic process such that W became 1 μm (FIG. 8C).

Step 4

Subsequently, the carbon layer and the TiN electrode were successively dry-etched. To completely etch the TiN electrode, over-etching was performed until the quartz substrate was slightly etched (FIG. 8D).

Step 5

Thereafter, the resist mask 33 was removed using a remover (FIG. 8F).

Subsequently, the carbon layer 5 was heat-treated in an ambient atmosphere of a mixed gas of methane and hydrogen by using a heat-treatment furnace (not shown), under the conditions described below.

Heat treatment temperature: 600° C.

Heating method: Lamp heating

Treatment time: 60 min

Gas ratio: methane:hydrogen=15:6

In this step, a dipole layer 11 was formed on the surface of the carbon layer 5. The surface of the carbon layer 5 at this stage was as flat as rms=0.2 nm (the roughness of the surface was measured for samples produced by depositing only a film on a Si substrate and performing a heat treatment).

Step 6

The electron emission device shown in FIGS. 15A and 15B, formed via the above-described steps was placed in a vacuum chamber, together with an anode electrode 4 including an ITO (indium tin oxide) layer coated with a phosphor placed at a location spaced by a distance H of 3 mm from the cathode electrode 2.

In this state, a maximum voltage was applied to the electron emission device in the forward direction and then in the reverse direction according to the process shown in FIG. 9B.

In this step of applying the maximum voltage, both Va and Vg were applied.

More specifically, Va was set to 5 kV, and a pulse with a pulse width of 1 msec, a repetition frequency of 500 Hz, and a duty of 50% was used to apply Vg. $Vg_1$, $Vg_2$, and $Vg_3$ were set to 18 V, 25 V, and 32 V, respectively.

As a result, the threshold values needed to emit electrons were increased to $V_{th_f1}=-V_{th_r1}=8$ V and $V_{th_f2}=-V_{th_r2}=13$ V, and $V_{th_r3}$ became −16V.

That is, after the completion of the characteristic adjustment process, the threshold voltages in the forward and reverse directions became $V_{th_f1}=13$ V and $V_{th_r}=-16$ V, respectively.

The electron emission device placed in the vacuum chamber was driven by an analog modulation voltage V=13 to 25 V. The brightness was modulated in response to the change in pulse height. As high an on/off ratio as 500:1 was obtained for the driving voltage of 25/13 V (i.e., the ratio of the luminescence produced when the forward driving voltage was 25 volts to the luminescence produced when the forward driving voltage was 13 volts sis 500:1), and thus high contrast was achieved.

In spite of the high flatness, the threshold electric field of the present electron emission device was low. More specifically, the carbon layer 5 produced in the present example was capable of being driven (to emit electrons) by applying an electric field of 15 V/μm.

As described above, in spite of the simple and symmetrical structure, the produced electron emission device was capable of emitting electrons at a low electric field and capable of operating in a highly stable manner.

Example 2

In Example 2, the carbon film shown in FIG. 2 was used.

Step 1

Step 1 was performed in a similar manner to step 1 of Example 1.

Step 2

Subsequently, to form the carbon layer 5, a DLC film with a thickness of 30 nm was deposited using an HFCVD (hot-filament chemical vapor deposition) method. The resistivity of the obtained DLC film was as high as $1\times10^{12}$ Ω·cm. The growth conditions employed are as follows:

Gas: $CH_4$
Substrate bias: −50 V
Gas pressure: 267 mPa
Substrate temperature: Room temperature
Filament: Tungsten
Filament temperature: 2100° C.

Subsequently, the carbon layer 5 was doped with cobalt by implanting cobalt into the carbon layer 5 with energy of 25 keV to a dose of $3\times10^{16}$ $cm^{-2}$.

Steps 3 to 5

Steps 3 to 5 were performed in a similar manner as in Example 1, except that dry etching conditions were adjusted depending on the film thickness of the carbon film.

Subsequently, using a lamp, heat treatment was performed at 550° C. for 60 min in an ambient of a mixture of acetylene (0.1%) and hydrogen (99.9%) Thus, a complete electron emission device was obtained.

The surface of the carbon layer 5 was as flat as rms=0.5 nm (the roughness of the surface was measured for samples produced by depositing only a film on a Si substrate and performing a heat treatment).

Step 6

As in Example 1, the electron emission device formed via the above-described steps was placed in a vacuum chamber, together with an anode electrode 4 including an ITO layer coated with a phosphor placed at a location spaced by a distance H of 2 mm from the cathode electrode 2.

In this state, a maximum voltage was applied to the electron emission device according to the process shown in FIG. 9B. More specifically, Va was set to 10 kV and a pulse with a pulse width of 5 msec, a repetition frequency of 40 Hz, and a duty of 20% was used to apply Vg. $Vg_1$, $Vg_2$, and $Vg_3$ were set to 20 V, 30 V, and 45 V, respectively.

As a result, the threshold values needed to emit electrons were increased to $V_{th_f1}=-V_{th_r1}=10$ V and $V_{th_f2}=-V_{th_r2}=18$ V, and $V_{th_r3}$ became −25 V.

That is, after the completion of the characteristic adjustment process, the threshold voltages in the forward and reverse directions became $V_{th_f}=18$ V and $V_{th_r}=-25$ V, respectively.

While maintaining the electron emission device in the vacuum chamber, the electron emission device was driven by a pulse-width-modulated signal with an amplitude of 35 V as shown in FIG. 9C. The intensity of light emitted from the anode electrode 4 composed of phosphor was modulated in accordance with the pulse width. As high an on/off ratio as 1000:1 was obtained for the driving voltage of 35/0 V (i.e., the ratio of the luminescence produced when the forward driving voltage was 35 volts to the luminescence produced when the forward driving voltage was 0 volts is 100:1), and thus high contrast was achieved.

In spite of the high flatness of the carbon layer 5, the threshold electric field of the electron emission device was low enough. The electric field needed to drive the electron emission device was 20 V/μm.

Thus, the drivability of the electron emission device of Example 2 was as good as that of Example 1.

In the present example, cobalt particles implanted in the DLC film aggregated via the annealing performed in a gas ambient (step 5). As a result, cobalt groups 9 in the form of crystal were dispersed in the carbon layer 5. A change also occurred in the DLC film via the annealing. Observation of the DLC film via a TEM (Transmission Electron Microscope) has revealed that the DLC film partially became graphite.

The cobalt groups result in local increases in conductivity. Thus, electrons in the vicinity of each cobalt group can easily reach the surface. Furthermore, the difference in dielectric constant between the cobalt groups and the DLC film causes the electric field to concentrate on a tip of each group, which makes it easier for electron emission to occur.

In the present example, as in Example 1, stable electron emission from the electron emission film with good flatness was achieved.

The carbon layer of the present example has discrete electron emission sites. The electron emission site density depends on the concentration of cobalt and the size of cobalt particles.

Although cobalt particles were used as the conductive particles in this example, other metal particles may also be used. Furthermore, the base material is not limited to the DLC film.

Example 3

An electron emission device having a structure shown in FIGS. 15A and 15B was produced.

Step 1

First, a substrate 1 of quartz glass was prepared. After the substrate 1 was cleaned well, a film of Ta with a thickness of 500 nm was deposited by means of sputtering to form a cathode electrode 2.

Step 2

Thereafter, an insulating film 61 was formed by depositing a $SiO_2$ film with a thickness (h) of 1 μm and then a gate electrode 3 was formed by depositing a Ta film with a thickness of 100 nm.

Step 3

Subsequently, a mask pattern was formed using a photolithography technique. More specifically, a positive photoresist (AZ1500 available from Clariant Corporation) was spin-coated and then exposed to a photomask pattern. Development was then performed thereby forming the mask pattern.

Step 4

By using the mask pattern as an etching mask, the gate electrode 3 of Ta was dry-etched using $CF_4$ gas and then the $SiO_2$ film 17 was etched using buffered hydrofluoric acid, thereby forming an opening with W=5 μm.

Step 5

The mask pattern was completely removed.

Step 6

Thereafter, as shown in FIG. 16E, amorphous carbon was deposited to a thickness of 100 nm using a hot filament CVD (HF-CVD) method via a metal deposition mask having an opening with a diameter of 100 μm.

The deposition of the amorphous carbon layer using the HF-CVD method was performed under the conditions described below.

Filament: Tungsten
Filament temperature: 1800° C.
Substrate temperature: Room temperature
Gas: Methane
Gas pressure: 0.1 Pa
Distance between substrate and filament: 50 mm
Substrate bias: 350V (applied to the conductive film 31)

Although the deposition process was performed at room temperature, the surface of the substrate was activated enough by irradiating the surface of the substrate with electrons emitted from the filament so that gas was decomposed and an amorphous carbon layer was deposited. The produced amorphous carbon layer was observed using an TEM. The observation revealed that the amorphous carbon layer had, not entirely but partially, a graphite structure. Although the unevenness with the detailed surface existed, the surface roughness was Rms=6 nm (it was measured, when an $n^+$-Si substrate is made to deposit only a film).

As in Examples 1 and 2, the electron emission device formed via the above-described steps was placed in a vacuum chamber, together with an anode electrode 4 including an ITO layer coated with a phosphor placed at a location spaced from the cathode electrode 2 by a distance H of 2 mm.

Subsequently, a maximum voltage was applied to the electron emission device so as to obtain the electrical characteristic shown in FIG. 17. More specifically, Va was fixed to 10 KV, and Vg was applied in the form of pulses with a pulse height ($Vg_2$) of −85 V, a pulse width of 1 msec, a repetition frequency of 500 Hz, and a duty of 50% according to the regimen shown in FIG. 9B to perform a characteristic adjustment process.

As a result of the application of the voltage, the reverse threshold voltage changed to 65 V (Vth_r2) from the initial value 50 V (Vth_r1).

While maintaining the electron emission device in the vacuum chamber, the electron emission device was driven by a pulse-width-modulated signal as shown in FIG. 9C. In FIG. 9C, $Vg_3$ was set to be 60 V. The intensity of light emitted from the anode electrode 4 composed of phosphor was modulated in accordance with the pulse width. An on/off ratio greater than 1000:1 was obtained for the driving voltage of 60/0 V (i.e., the ratio of the luminescence produced when the forward driving voltage was 60 volts to the luminescence produced when the forward driving voltage was 0 volts it 1000:1), and thus high contrast was achieved.

The electron emission device produced in the present example was capable of being driven by applying an electric field of 50 V/μm.

Eg is determined by the distance between the cathode electrode and the control electrode. In the structure of the electron emission device according to the second embodiment, the distance between the cathode electrode and the control electrode is determined by the thickness h of the insulating layer 61. Thus, the distance between the cathode electrode and the control electrode in the second embodiment can be smaller than that according to the first embodiment. This makes it possible to drive the electron emission device by a smaller driving voltage. The electron beam diameter depends on the diameter W of the opening. The beam size can be reduced by reducing the diameter W of the opening.

Many openings may be formed in each electron emission device. The shape of each opening is not limited to a circle, but each opening may be formed in another shape such as a rectangle.

Although the electron emission device of the present example was capable of emitting electrons in low strength electric fields, no change in the electron emission character occurred for a long term.

In the production process of the present example, after the electron emission material is deposited, the electron emission material is not exposed to chemicals such as an etchant or a remover, and thus no degradation in characteristic occurs. The process employed in this example can also be used for a structure having an opening with a diameter W less than 5 μm.

Example 4

An electron source substrate 41 having a 1000×1000 array of electron devices was produced. The array of electron emission devices was produced using the process employed in Example 1. An image display device was then produced using the electron source substrate.

Wirings 42 and 43 were produced such that each wiring 42 extending in the X direction is connected to cathode electrodes 2 of electron emission devices 44 located in a corresponding row, and each wiring 43 extending in the Y direction is connected to gate electrodes 3 of electron emission devices 44 located in a corresponding column. The distance between adjacent electron emission devices 44 is set to be 300 μm in both X and Y directions.

The produced electron source substrate 41 was placed on a rear plate 51 and fixed. A frame 52 was then placed thereon and a face plate 56 composed of a fluorescent film 54 and a metal back 55 serving as the anode electrode 4 was placed on the frame 52, and they were bonded together so as to form a panel shown in FIG. 13.

The distance H between the electron source substrate 41 and the face plate 56 was set to be 3 mm.

In this state, the characteristic adjustment process was performed such that the emission current Ie at the maximum forward voltage became substantially equal for all electron emission devices.

More specifically, a voltage $Vg_2$=25 (volts) was applied between the cathode electrode 2 and the gate electrode 3 of each electron emission device 44, and a resultant emission current Ie of each electron emission device 44 was stored in a memory. For electron emission devices having large emission currents, a slightly greater forward voltage was further applied so that all electron emission devices 44 had a substantially equal emission current when a normal driving voltage (25 V in this specific example) was applied.

Thus, the variation in the required driving voltage due to the variation in the distance between electrodes was corrected such that substantially equal currents were obtained.

Thereafter, a voltage 1.5 times greater than the maximum forward voltage, that is, 40 V was applied in the reverse direction.

The obtained image display device was driven as shown in FIG. 14A.

Voltages were set such as Vs=0 V, Vns=12.5 V, Vm=25 V, Vnm=12.5 V, and Va=5 kV.

As in Example 1, $E_{th_r}$=13 V was obtained for each electron emission element. Because $E_{th_r}$ is greater than 12. 5 V that is applied in the semi-selected state, a good off-state characteristic was obtained in the semi-selected state. Thus, when the image display device was driven using the matrix driving method, a good display characteristic was obtained.

The adjustment of Ie to equal values for all electron emission devices in the image display device in the characteristic adjustment process made it possible for the image display device to have an uniform characteristic over the entire screen. Furthermore, the image display device was able to operate in a very stable and highly reliable fashion for a long period.

Example 5

An electron source substrate 41 similar to that in Example 4 was produced, and a panel having the structure shown in FIG. 13 was produced using the electron source substrate 41. The distance H between the electron source substrate 41 and the face plate 56 was set to be 1.5 mm.

The anode voltage Va during an actual operation was set to 10 kV.

The characteristic adjustment was performed as follows.

Figure 18A:
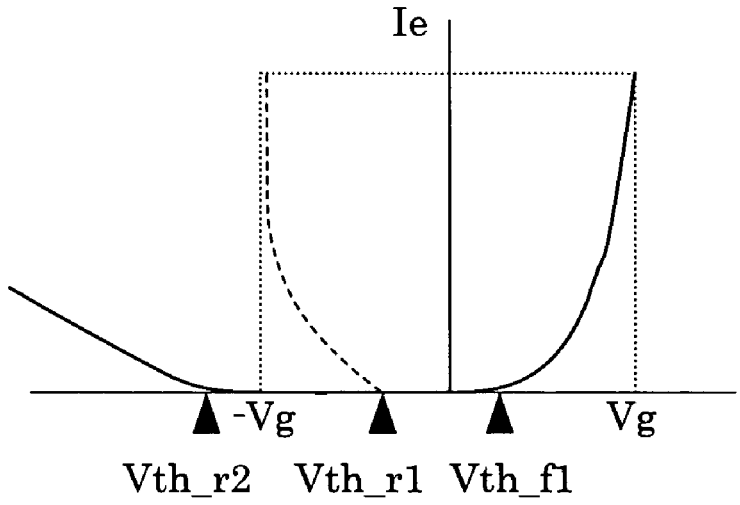
FIG. 18A is a graph showing an electrical characteristic of an electron emission device subjected to a characteristic adjustment process according to the present invention.

When $Vg_1$=22 V was applied in the forward and reverse directions, the forward threshold electric field Vth_f1 and the reverse threshold electric field Vth_r1 shown in FIG. 18A were obtained. More specifically, the forward threshold electric field Vth_f1 was set during the characteristic adjustment process by increasing the voltage applied to the device to a voltage $Vg_1$ of 22 V, returning the voltage to 0, and again increasing the voltage to 22 V. The initial reverse threshold electric field Vth_r1 was set during the characteristic adjustment process by decreasing the voltage applied to the device to the voltage $-Vg_1$ of −22 V, returning the voltage to 0, and again decreasing the voltage to −22 V.

The resultant I-V characteristic is shown in FIG. 18A. As a result of the application of $Vg_1$=22 V, $V_{th_f1}$=10 V was obtained.

Although the same electron source substrate was used as that in Example 4, the electrical characteristic was different from that in Example 4 because of a difference in Ea.

That is, in contrast to $Ea_{av}$=5 kV/3 mm=1.67 V/μm in Example 4, $Ea_{av}$=10 kV/1.5 mm=6.7 V/μm in this example, and thus $Ea_{av}$ in this example is 4 times greater than that in Example 4.

In the driving method shown in FIG. 11B, 11 V is applied in the semi-selected state during an actual operation of the electron emission device. However, this voltage is greater than $V_{th_r1}$=10 V shown in FIG. 18A, and thus a complete off-state is not obtained in the semi-selected state.

To avoid the above problem, a voltage $Vb_2$=−30 V was applied in the reverse direction during the characteristic adjustment process (i.e., the voltage of −30 V was applied to the electron emission device, the voltage was returned to 0 volts, and then the voltage was again decreased to −30 V). As a result, an I-V characteristic represented by solid lines in FIG. 18A was obtained, and $V_{th_r}$ was changed to $V_{th_r2}$=24 V.

Figure 18B:
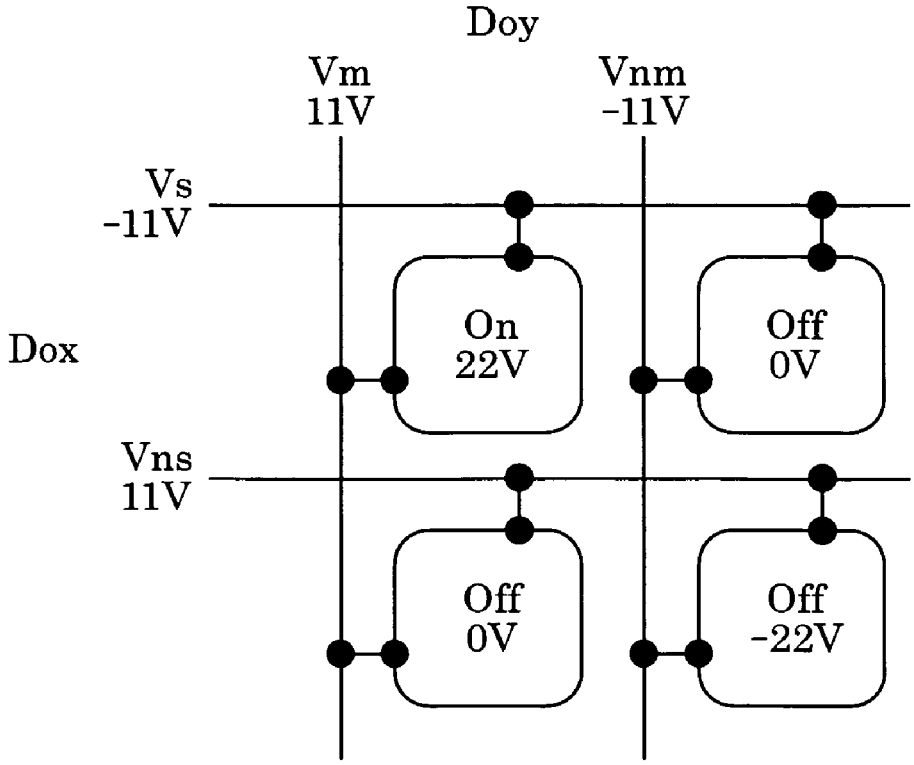
FIG. 18B is a schematic diagram showing the manner in which electron emission devices are driven according to the present invention.

The obtained image display device using the electron emission source was driven as shown in FIG. 18B. As shown in FIGS. 14A and 14B, in FIG. 18B, scan signals are applied along wirings or scanning lines denoted as Dox extending in the X direction, while the modulation signals are applied along the wirings or signal lines denoted as Doy extending in the Y direction. Two scanning lines are shown in these figures, one of which applies a voltage Vs to two electron emission devices and the other of which applies a voltage Vns to two electron emission devices. Two signal lines are also shown in these figures, one of which applies a voltage of Vm to two electron emission devices and the other of which applies a voltage of Vnm to two electron emission devices.

Voltages were set such that Vs=−11 V, Vns=11 V, Vm=11V, and Vnm=−11V.

In the case in which the voltages are set as described above in the driving method shown in FIG. 18B, 0 V is applied to semi-selected electron emission devices, and −22 V is applied to non-selected electron emission devices, and thus a good off-state was obtained for non-selected and semi-selected electron emission devices. Thus, when the image display device was driven using the matrix driving method, a good display characteristic was obtained.

In this example, a smaller driving voltage was needed than in Example 4.

Furthermore, in this example, a smaller beam size was obtained than that obtained in Example 4 because of large Ea and the small driving voltage. The result indicates that it is possible to reduce the distance between adjacent electron emission devices (to a value less than 300 μm in both X and Y directions).

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-070827 filed Mar. 12, 2004, which is hereby incorporated by reference herein.

What is claimed is:

1. A method of producing an electron emission device comprising a first conductive film having an electron emission part and a second conductive film spaced apart from the first conductive film, the electron emission device capable of being driven by applying a higher electric potential to the second conductive film than an electric potential of the first conductive film, the method comprising:

(A) a first step of preparing a first conductive film, second conductive film, and a material which constitutes an electron emission part and is connected at least to the first conductive film, and (B) a second step of setting a threshold electric field strength, which is needed to start electron emission in a situation where a higher electric potential is applied to the first conductive film than that applied to the second conductive film, to a value greater than a threshold electric field strength, which is needed to start electron emission in a situation where a higher electric potential is applied to the second conductive film than that applied to the first conductive film, by performing electron emission by applying a voltage between the first conductive film and the second conductive film in a forward direction such that an electric potential of the second conductive film is higher than an electric potential of the first conductive film, and by performing electron emission by applying a voltage between the first conductive film and the second conductive film in a reverse direction such that an electric potential of the first conductive film is higher than an electric potential of the second conductive film, after the first step, wherein a maximum value of an absolute value of the voltage in the reverse direction is greater than a maximum value of an absolute value of the voltage in the forward direction and is greater than an absolute value of a voltage applied between the first conductive film and the second conductive film when the electron emission device is driven.

2. A method of producing an electron emission device according to claim 1, wherein electrons are emitted by applying an electric field of $1\times10^6$ V/cm or less to the electron emission part.

3. A method of producing an electron emission device according to claim 2, wherein the first conductive film and the second conductive film are spaced apart by 0.1 μm or greater.

4. A method of producing an electron emission device according to claim 1, wherein the electron emission part is formed of a material selected from the group consisting of a carbon fiber, an insulating film having a dipole layer disposed on the surface thereof, a film formed mainly of carbon and including metal particles, and an amorphous carbon layer.

5. A method of producing an electron source including a plurality of electron emission devices, the method including the step of producing the plurality of electron emission devices using a production method according to claim 4.

6. A method of producing an image display device including an electron source and a luminescent material, the method including the step of producing the electron source using a production method according to claim 5.

7. A method of producing an electron emission device comprising a first conductive film having an electron emission part and a second conductive film spaced apart from the first conductive film, the electron emission device capable of being driven by applying a higher electric potential to the second conductive film than an electric potential of the first conductive film, the method comprising:

(A) a first step of preparing a first conductive film, second conductive film, and a material which constitutes an electron emission part and is connected at least to the first conductive film, and (B) a second step of setting a threshold electric field strength, which is needed to start electron emission in a situation where a higher electric potential is applied to the first conductive film than that applied to the second conductive film, to a value greater than a threshold electric field strength, which is needed to start electron emission in a situation where a higher electric potential is applied to the second conductive film than that applied to the first conductive film, by performing electron emission by applying a voltage between the first conductive film and the second conductive film in a forward direction such that an electric potential of the second conductive film is higher than an electric potential of the first conductive film, and by performing electron emission by applying a voltage between the first conductive film and the second conductive film in a reverse direction such that an electric potential of the first conductive film is higher than an electric potential of the second conductive film, after the first step, wherein the electron emission device is produced by a production method in which a maximum value of an absolute value of the voltage in the reverse direction is greater than a maximum value of an absolute value of the voltage in the forward direction, and wherein an absolute value of a voltage applied between the first conductive film and the second conductive film when the electron emission device is driven is smaller than a maximum value of an absolute value of the voltage in the reverse direction.

* * * * *